US010895205B1

(12) United States Patent
Black et al.

(10) Patent No.: US 10,895,205 B1
(45) Date of Patent: Jan. 19, 2021

(54) MULTI-PORT INJECTION SYSTEM

(71) Applicant: FlowCore Systems, LLC, Williston, ND (US)

(72) Inventors: Ian C. Black, Williston, ND (US); Alec J. Driscoll, Williston, ND (US); Charles D. Black, Williston, ND (US); Steven E. Hayden, Williston, ND (US)

(73) Assignee: FlowCore Systems, LLC, Williston, ND (US)

( * ) Notice: Subject to any disclaimer, the term of this patent is extended or adjusted under 35 U.S.C. 154(b) by 0 days.

(21) Appl. No.: 16/596,053

(22) Filed: Oct. 8, 2019

(51) Int. Cl.
*F02D 19/08* (2006.01)
*F02D 19/06* (2006.01)

(52) U.S. Cl.
CPC ..... *F02D 19/087* (2013.01); *F02D 19/061* (2013.01); *F02D 19/0692* (2013.01)

(58) Field of Classification Search
CPC .. F02D 19/087; F02D 19/061; F02D 19/0692; E21B 43/116; E21B 47/10; E21B 47/008
See application file for complete search history.

(56) References Cited

U.S. PATENT DOCUMENTS 4,282,093 A 8/1981 Haga
4,404,944 A * 9/1983 Yamazaki ..... F02M 37/20 123/458
4,538,445 A 9/1985 Kenik
4,648,043 A 3/1987 O'Leary
5,140,965 A * 8/1992 Nogi ..... F02D 41/2425 123/494
5,515,280 A * 5/1996 Suzuki ..... G01N 33/2852 701/29.2
6,074,551 A 6/2000 Jones
6,129,104 A 10/2000 Ellard
6,200,466 B1 3/2001 Bender
6,773,611 B2 8/2004 Perlich
6,981,553 B2 1/2006 Stegemeier
(Continued)

FOREIGN PATENT DOCUMENTS

KR 20130066108 6/2013

OTHER PUBLICATIONS http://www.enbasesolutions.com/index.php; Chemical Automation System from Enbase Solutions; Received and Printed on Sep. 30, 2014.

(Continued)

*Primary Examiner* — George C Jin
(74) *Attorney, Agent, or Firm* — Neustel Law Offices

(57) ABSTRACT

A multi-port injection system for injecting fluid into a plurality of fluid injection ports during a plurality of fluid injection cycles. The system provides highly accurate measurement of the volume of fluid injected into each injection port during each fluid injection cycle. The system generally includes a fluid holding tank, measuring tubes, a pump, a plurality of port valves coupled to the fluid injection ports, a fluid return valve, volume sensors, and a control unit. During a fluid injection cycle the control unit causes a portion of fluid to be pumped from a measuring tube to a port valve. After each fluid injection cycle, the control unit causes the fluid return valve to return the portion of fluid that was not injected to the measuring tube before the volume of fluid injected is measured.

37 Claims, 7 Drawing Sheets

(56) References Cited

U.S. PATENT DOCUMENTS

| | | | | |
|---|---|---|---|---|
| 7,263,448 | B2 | 8/2007 | Brown | |
| 7,955,853 | B2 | 6/2011 | Hicks | |
| 8,066,940 | B2 | 11/2011 | Denkewicz, Jr. | |
| 8,515,581 | B2 | 8/2013 | Piironen | |
| 8,532,829 | B2 | 9/2013 | Haller | |
| 10,144,653 | B2 | 12/2018 | Black | |
| 2004/0149436 | A1* | 8/2004 | Sheldon | E21B 43/116 166/250.15 |
| 2009/0112364 | A1 | 4/2009 | Chen | |
| 2009/0326788 | A1* | 12/2009 | Yuasa | F02D 41/3809 701/104 |
| 2011/0241230 | A1 | 10/2011 | Kerfoot | |
| 2012/0048242 | A1* | 3/2012 | Surnilla | F02D 19/022 123/497 |
| 2013/0068532 | A1 | 3/2013 | Bansal | |
| 2013/0126152 | A1 | 5/2013 | Banks | |
| 2013/0153231 | A1 | 6/2013 | Ayres | |
| 2013/0192841 | A1 | 8/2013 | Feasey | |
| 2014/0246508 | A1* | 9/2014 | Caley | F02D 19/0694 239/5 |
| 2015/0090645 | A1 | 4/2015 | Black | |
| 2019/0100444 | A1* | 4/2019 | Black | G05D 11/131 |

OTHER PUBLICATIONS

PCT Search Report Received from the International Searching Authority; Received and Printed on Jan. 6, 2015.

Wave Control Systems Ltd Uninterruptable Chemical Supply System Operational Brochure; Prior to Application Filing Date.

http://wavecontrol.ca/our-products/chemical-injection-metering-and-monitoring-packages/; Wave Control Systems Ltd Webpage; Prior to Application Filing Date.

http://www.profireenergy.com/products/PC180_fuel_package.html; Profire Energy PC180 Full Tank Package Webpage; Prior to Application Filing Date.

http://www.graco.com/us/en/products/business-unit/ong.html; Graco Oil & Natural Gas Product Webpage; Prior to Application Filing Date.

* cited by examiner

MULTI-PORT INJECTION SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND

Field

Example embodiments in general relate to a multi-port injection system for injecting volumes of fluid such as a chemical into a plurality of injection ports in a plurality of fluid injection cycles, and providing highly accurate measurements of the volume of fluid injected into each injection port and across the plurality of injection ports.

Related Art

Any discussion of the related art throughout the specification should in no way be considered as an admission that such related art is widely known or forms part of common general knowledge in the field.

It is known in the oil and gas industry and other industries to inject certain fluids into injection ports of various injection points for various purposes. For example, in the oil industry, it is known to inject a volume of chemically treated water into an injection port of an oil well to act as a scale inhibitor, a corrosion inhibitor, a desalination chemical and/or a biocide. It is also known in the oil and gas industry to inject a volume of methanol into an injection port of a gas compressor station or of a gas line to reduce the freezing point of residual water that may be present.

It is important to be able to accurately determine the volume of fluid injected into an individual fluid injection port of an injection point, and to be able to accurately determine the volume of fluid injected into each of a plurality of injection ports of a plurality of injection points, where the fluid is injected into the injection ports in a series of fluid injection cycles. Similarly, it is important to be able to accurately determine the total volume of fluid injected into a plurality of injection ports of a plurality of injection points in a series of fluid injection cycles over a prescribed period of time.

Typically, a plurality of injection ports to be injected with fluid in a series of fluid injection operations will share a common manifold or other fluid path from a source of the fluid to be injected. In addition, it is typical for each injection port to have its own port valve. With such an arrangement, a challenge can arise in accurately measuring the volume of fluid injected into an individual injection port and in measuring the volumes of fluids injected into each of a plurality of the injection ports during a series of fluid injection cycles. The challenge is greater when the injection ports feed high pressure injection points or when the injection ports exhibit widely varying pressures.

For example, in such an arrangement, one injection port into which fluid is to be injected may require fluid to be injected at a relatively high pressure, approximately 1300 psi for example. Another injection port to be injected with the fluid may require fluid to be injected at a relatively lower pressure, for example 150 psi.

After injecting fluid into the higher pressure port and closing its port valve, it is not uncommon for excess fluid that was not actually injected into the port to remain in the manifold and perhaps other components of the system. It also is not uncommon for residual high pressure to remain in the manifold and perhaps other components. If the volume of excess fluid is included as part of the measured volume of fluid injected into the port then the measured volume of injected fluid is in error.

Further, if the lower pressure injection port is the next port to be injected with the fluid, when the port valve of the lower pressure port is opened, the excess fluid remaining in the manifold and perhaps other components will flow under the force of the residual pressure in the system into the low pressure port. Thus, the volume of the excess fluid, which was already erroneously measured as having been injected into the higher pressure port, will now flow into the lower pressure port, causing the measured volume of injected fluid into the lower pressure port to also be in error. Such measurement errors can cascade when a plurality of injection ports are to be injected in a series of fluid injection operations. Not only are the individual measured volumes of fluid injected into individual ports rendered erroneous, but extremely high deviation in the accuracy of measured injected fluid volume from port to port can occur.

The multi-point injection system described herein addresses these problems and shortcomings and provides highly accurate determinations of the volumes of fluids injected into individual injection ports as well as highly accurate determinations of injected fluid volumes from port to port when a plurality of ports are to be injected with fluid in a series of fluid injection cycles.

SUMMARY

An example embodiment is directed to a multi-port injection system. The multi-port injection system includes a holding tank for holding a fluid, a first measuring tube for receiving a first portion of the fluid from the holding tank, a plurality of port valves each coupled to a fluid injection port, and a pump operable to pump the first portion of the fluid from the first measuring tube to a selected port valve for injection into a selected fluid injection port. The multi-port injection system further includes a fluid return valve coupled between the port valves and the first measuring tube, a first sensor coupled to the first measuring tube to provide an indication of the volume of the first portion of the fluid in the first measuring tube, and a control unit in communication with the port valves, the pump, the fluid return valve and the first sensor.

The control unit is configured to carry out a first fluid injection cycle in which a first selected port valve is opened, and the pump is operated to pump the first portion of the fluid from the first measuring tube to the first selected port valve for injection into a first selected fluid injection port. The control unit is further configured to close the first selected port valve and to open the fluid return valve to return the first portion of the fluid that was not injected during the first fluid injection cycle to the first measuring tube.

The control unit is further configured to determine from the first sensor the volume of the first portion of the fluid that was injected into the first selected fluid injection port during the first fluid injection cycle based on the volume of the first portion of the fluid present in the measuring tube before and after the first fluid injection cycle.

According to another aspect of the multi-port injection system, the system also includes a fluid pressure sensor coupled to the pump and to the plurality of port valves. The fluid pressure sensor is in communication with the control unit and is operable to provide an indication of the pressure the first portion of the fluid that was not injected during the first fluid injection cycle is under. The control unit is further configured to determine from the fluid pressure sensor the pressure the first portion of the fluid that was not injected during the first fluid injection cycle is under and to close the fluid return valve when the pressure becomes less than a predetermined value.

According to another aspect of the multi-port injection system, the system also includes a second measuring tube for receiving a second portion of the fluid from the holding tank, and a control valve coupled to the first measuring tube, to the second measuring tube, and to the pump. The control unit is further configured to operate the control valve to direct the first portion of the fluid from the first measuring tube to the pump for carrying out the first fluid injection cycle. The control unit is configured to determine from the first sensor following the first fluid injection cycle whether the volume of the first portion of the fluid in the first measuring tube is sufficient to carry out a second fluid injection cycle. The control unit is further configured to operate the control valve to direct the second portion of the fluid from the second measuring tube to the pump if the volume of the first portion of the fluid is not sufficient, and to carry out the second fluid injection cycle using the second portion of the fluid from the second measuring tube.

According to another aspect of the multi-port injection system, the control unit is further configured to operate the control valve and the fluid return valve to return the second portion of the fluid that was not injected during the second fluid injection cycle to the second measuring tube. The control unit is further configured to determine from the fluid pressure sensor the pressure the second portion of the fluid that was not injected during the second fluid injection cycle is under and to close the fluid return valve when the pressure becomes less than a predetermined value.

According to another aspect of the multi-port injection system, the system includes a second sensor coupled to the second measuring tube to provide an indication of volume of the second portion of the fluid in the second measuring tube. The control unit is further configured to determine from the second sensor whether a sufficient volume of the second portion of the fluid is present in the second measuring tube to carry out a third fluid injection cycle. If the control unit determines the volume of the second portion of the fluid is not sufficient to carry out a third fluid injection cycle, the control unit operates the control valve to direct a third portion of fluid from the first measuring tube to the pump and carries out the third fluid injection cycle using the third portion of the fluid from the first measuring tube.

According to yet another aspect of the multi-port injection system, the system includes a first fill valve coupled to the holding tank and the first measuring tube, and a second fill valve coupled to the holding tank and to the second measuring tube. The control unit is further configured to operate the first fill valve to transfer the first portion and the third portion of the fluid from the holding tank to the first measuring tube and to operate the second fill valve to transfer the second portion of the fluid from the holding tank to the second measuring tube.

There has thus been outlined, rather broadly, some of the embodiments of the multi-port injection system in order that the detailed description thereof may be better understood, and in order that the present contribution to the art may be better appreciated. There are additional embodiments of the multi-port injection system that will be described hereinafter and that will form the subject matter of the claims appended hereto. In this respect, before explaining at least one embodiment of the multi-port injection system in detail, it is to be understood that the multi-port injection system is not limited in its application to the details of construction or to the arrangements of the components set forth in the following description or illustrated in the drawings. The multi-port injection system is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

Figure 1:
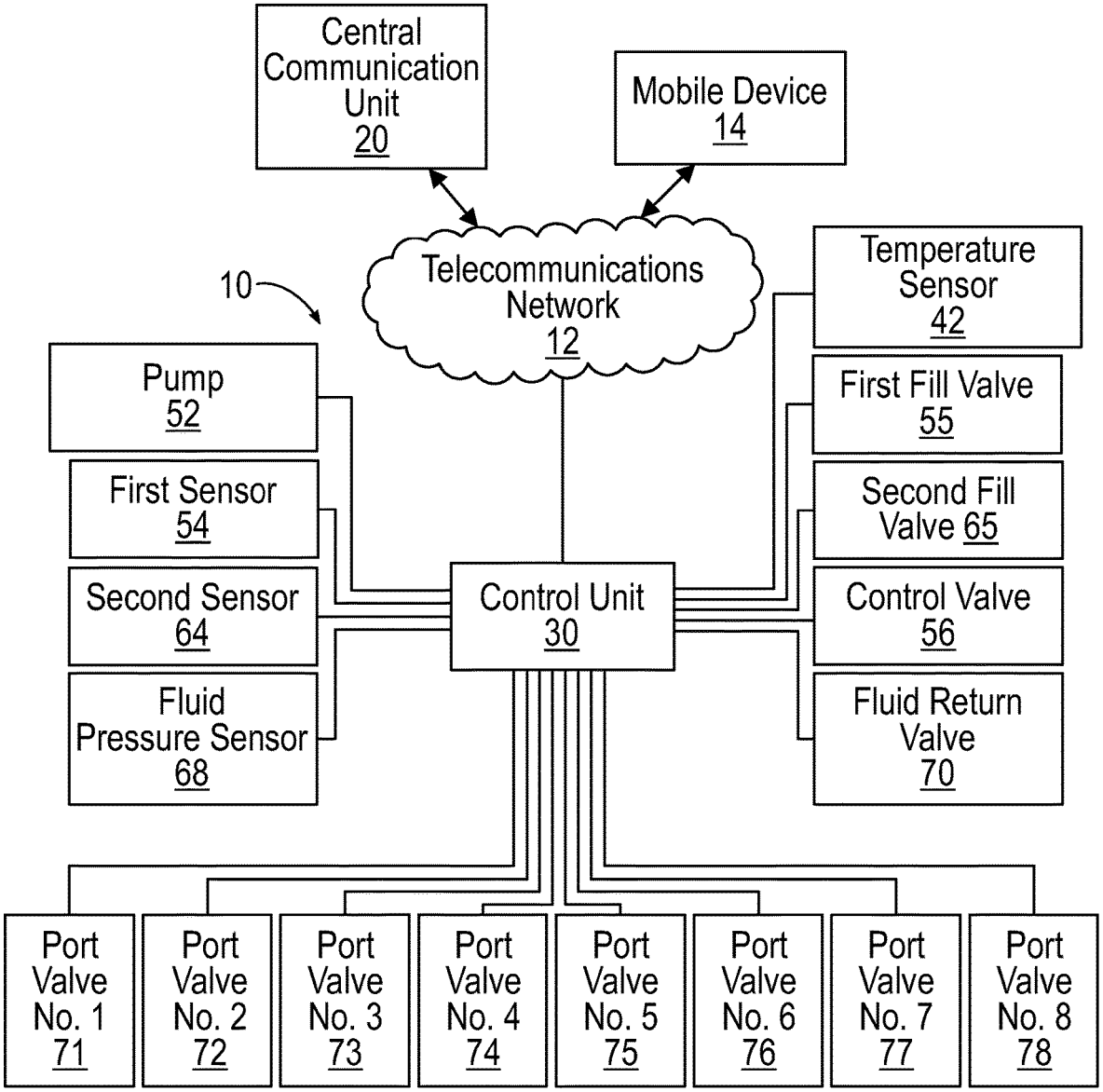
FIG. 1 is a block diagram illustrating the control and communications between the various components of a multi-port injection system in accordance with an example embodiment.

A. Overview.

FIGS. 1-5 illustrate example embodiments of a multi-port injection system 10 embodying the present invention. An example multi-port injection system 10 generally includes a holding tank 58 for holding a fluid, a first measuring tube 53 for receiving a first portion and additional portions of the fluid from the holding tank 58, a second measuring tube 63 for receiving a second portion and additional portions of the fluid from the holding tank 58, a first fill valve 55 coupled to the holding tank 58 and the first measuring tube 53, and a second fill valve 65 coupled to the holding tank 58 and to the second measuring tube 63.

The multi-port injection system 10 also includes a plurality of port valves 71-78 each coupled to a fluid injection port, and a pump 52 coupled to the plurality of port valves 71-78 and to the first measuring tube 53 and the second measuring tube 63. The pump 52 is operable to pump the first portion and additional portions of the fluid from the first measuring tube 53 to selected port valves 71-78 for injection into selected fluid injection ports during a first fluid injection cycle and subsequent fluid injection cycles. The pump 52 is also operable to pump the second portion and additional portions of the fluid from the second measuring tube 63 to selected port valves 71-78 for injection into selected fluid injection ports during a second fluid injection cycle and subsequent fluid injection cycles.

The multi-port injection system 10 further includes one or more control valves 56, 57 coupled to the first and second measuring tubes 53, 63 and to the pump 52, a fluid return valve 70 coupled between the port valves 71-78 and the first and second measuring tubes 53, 63, and a fluid pressure sensor 68 coupled to the pump 52 and to the plurality of port valves 71-78. The fluid pressure sensor 68 provides an indication of the pressure a fluid that was not injected during a fluid injection cycle is under. The multi-port injection system 10 further includes a first sensor 54 coupled to the first measuring tube 53 that provides an indication of the volume of the fluid in the first measuring tube 53, and a second sensor 64 coupled to the second measuring tube 63 that provides an indication of the volume of the fluid in the second measuring tube 63.

The multi-port injection system 10 further includes a control unit 30 in communication with the first and second fill valves 55, 65, the one or more control valves 56, 57, the port valves 71-78, the pump 52, the fluid return valve 70, the first and second sensors 54, 64, and the fluid pressure sensor 68.

The control unit 30 is configured to carry out a first fluid injection cycle in which a first selected port valve 71-78 is opened, one of the control valves 56 is operated to direct the first portion of the fluid from the first measuring tube 53 to the pump 52, and the pump 52 is operated to pump the first portion of the fluid from the first measuring tube 53 to the first selected port valve 71-78 for injection into a first selected fluid injection port.

The control unit 30 is further configured to subsequently close the first selected port valve 71-78 and open the fluid return valve 70 to return the first portion of the fluid that was not injected during the first fluid injection cycle to the first measuring tube 53. The control unit 30 is further configured to determine from the fluid pressure sensor 68 the pressure the first portion of the fluid that was not injected during the first fluid injection cycle is under and to close the fluid return valve 70 when the pressure becomes less than a predetermined value.

The control unit 30 is further configured to determine from the first sensor 54 the volume of the first portion of the fluid that was injected into the selected fluid injection port during the first fluid injection cycle based on the volume of the first portion of the fluid present in the first measuring tube 53 before the first fluid injection cycle and after the first fluid injection cycle. The volume of the first portion of the fluid after the first fluid injection cycle comprises the volume of the first portion of the fluid that remained in the first measuring tube 53 during the first fluid injection cycle, and the volume of excess first portion of the fluid that was not injected during the first fluid injection cycle and was returned to the first measuring tube 53.

The control unit 30 is also configured to determine from the first sensor 54 following the first fluid injection cycle whether the volume of the first portion of the fluid in the first measuring tube 53 is sufficient to carry out a second fluid injection cycle. If the control unit 30 determines the volume of the first portion of the fluid is sufficient to carry out the second fluid injection cycle, the second fluid injection cycle is carried out using the first portion of the fluid from the first measuring tube 53. In the second fluid injection cycle, a second selected port valve 71-78 is opened, the control valve 56 is operated to direct the second portion of the fluid from the first measuring tube 53 to the pump 52, and the pump 52 is operated to pump the first portion of the fluid from the first measuring tube 53 to the second selected port valve 71-78 for injection into a second selected fluid injection port. If the control unit 30 determines the volume of the first portion of the fluid is not sufficient to carry out the second fluid injection cycle, the control unit 30 operates one or both of the control valves 56, 57 to direct the second portion of the fluid from the second measuring tube 63 to the pump 52, and carries out the second fluid injection cycle using the second portion of the fluid from the second measuring tube 63.

The control unit 30 is further configured to operate one or both of the control valves 56, 57 and the fluid return valve 70 to return the second portion of the fluid that was not injected during the second fluid injection cycle to the second measuring tube 63. The control unit 30 is further configured to determine from the fluid pressure sensor 68 the pressure the second portion of the fluid that was not injected during the second fluid injection cycle is under and to close the fluid return valve 70 when the pressure becomes less than a predetermined value.

The control unit 30 is further configured to determine from the second sensor 64 whether a sufficient volume of the second portion of the fluid is present in the second measuring tube 63 to carry out a third fluid injection cycle. If the control unit 30 determines the volume of the second portion of the fluid is not sufficient to carry out a third fluid injection cycle, the control unit 30 operates the control valve 56 to direct a third portion of fluid from the first measuring tube 53 to the pump 52 and carries out the third fluid injection cycle using the third portion of the fluid from the first measuring tube 53.

The control unit 30 is further configured to operate the first fill valve 55 to transfer the first portion and the third portion of the fluid from the holding tank 58 to the first measuring tube 53 and the second fill valve 65 to transfer the second portion of the fluid from the holding tank 58 to the second measuring tube 63. The control unit 30 is configured to operate the first fill valve 55 and the second fill valve 65 to alternately fill the first measuring tube 53 and the second measuring tube 63 as the other tube is being used for a fluid injection cycle.

B. Exemplary Telecommunications Networks.

The multi-port injection system 10 may be utilized upon any telecommunications network 12 capable of transmitting data including voice data and other types of electronic data. Examples of suitable telecommunications networks for the multi-port injection system include but are not limited to global computer networks (e.g. Internet), wireless networks, cellular networks, satellite communications networks, cable communication networks (via a cable modem), microwave communications network, local area networks (LAN), wide area networks (WAN), campus area networks (CAN), metropolitan-area networks (MAN), and home area networks (HAN). The multi-port injection system 10 may communicate via a single telecommunications network 12 or multiple telecommunications networks 12 concurrently. Various protocols may be utilized by the electronic devices for communications such as but not limited to HTTP, SMTP, FTP and WAP (wireless Application Protocol). The multi-port injection system may be implemented upon various wireless networks such as but not limited to 3G, 4G, LTE, CDPD, CDMA, GSM, PDC, PHS, TDMA, FLEX, REFLEX, IDEN, TETRA, DECT, DATATAC, and MOBITEX. The multi-port injection system may also be utilized with online services and internet service providers.

The Internet is an exemplary telecommunications network 12 for the multi-port injection system. The Internet is comprised of a global computer network having a plurality of computer systems around the world that are in communication with one another. Via the Internet, the computer systems are able to transmit various types of data between one another. The communications between the computer systems may be accomplished via various methods such as but not limited to wireless, Ethernet, cable, direct connection, telephone lines, and satellite.

C. Central Communication Unit.

The central communication unit 20 may be comprised of any central communication site where communications are preferably established with. The central communication units 20 may be comprised of a server computer, cloud based computer, virtual computer, home computer or other computer system capable of receiving and transmitting data via IP networks and the telecommunication networks 12. As can be appreciated, a modem or other communication device may be required between each of the central communication units 20 and the corresponding telecommunication networks 12. The central communication unit 20 may be comprised of any electronic system capable of receiving and transmitting information (e.g. voice data, computer data, etc.).

D. Mobile Device.

The mobile device 14 may be comprised of any type of computer for practicing the various aspects of the multi-port injection system. For example, the mobile device can be a personal computer (e.g. APPLE® based computer, an IBM based computer, or compatible thereof) or tablet computer (e.g. IPAD®). The mobile device 14 may also be comprised of various other electronic devices capable of sending and receiving electronic data including but not limited to smartphones, mobile phones, telephones, personal digital assistants (PDAs), mobile electronic devices, handheld wireless devices, two-way radios, smart phones, communicators, video viewing units, television units, television receivers, cable television receivers, pagers, communication devices, and digital satellite receiver units.

The mobile device 14 may be comprised of any conventional computer. A conventional computer preferably includes a display screen (or monitor), a printer, a hard disk drive, a network interface, and a keyboard. A conventional computer also includes a microprocessor, a memory bus, random access memory (RAM), read only memory (ROM), a peripheral bus, and a keyboard controller. The microprocessor is a general-purpose digital processor that controls the operation of the computer. The microprocessor can be a single-chip processor or implemented with multiple components. Using instructions retrieved from memory, the microprocessor controls the reception and manipulations of input data and the output and display of data on output devices. The memory bus is utilized by the microprocessor to access the RAM and the ROM. RAM is used by microprocessor as a general storage area and as scratch-pad memory, and can also be used to store input data and processed data. ROM can be used to store instructions or program code followed by microprocessor as well as other data. A peripheral bus is used to access the input, output and storage devices used by the computer. In the described embodiments, these devices include a display screen, a printer device, a hard disk drive, and a network interface. A keyboard controller is used to receive input from the keyboard and send decoded symbols for each pressed key to microprocessor over bus. The keyboard is used by a user to input commands and other instructions to the computer system. Other types of user input devices can also be used in conjunction with the multi-port injection system. For example, pointing devices such as a computer mouse, a track ball, a stylus, or a tablet to manipulate a pointer on a screen of the computer system. The display screen is an output device that displays images of data provided by the microprocessor via the peripheral bus or provided by other components in the computer. The printer device when operating as a printer provides an image on a sheet of paper or a similar surface. The hard disk drive can be utilized to store various types of data. The microprocessor together with an operating system operate to execute computer code and produce and use data. The computer code and data may reside on RAM, ROM, or hard disk drive. The computer code and data can also reside on a removable program medium and loaded or installed onto computer system when needed. Removable program mediums include, for example, CD-ROM, PC-CARD, USB drives, floppy disk and magnetic tape. The network interface circuit is utilized to send and receive data over a network connected to other computer systems. An interface card or similar device and appropriate software implemented by microprocessor can be utilized to connect the computer system to an existing network and transfer data according to standard protocols.

E. Holding Tank.

As illustrated in FIGS. 2-5, the multi-port injection system 10 includes a holding tank 58. The holding tank 58 holds a fluid to be injected by the multi-port injection system 10. The fluid may comprise an additive fluid such as water, or a water treatment chemical such as a scale inhibitor, a corrosion inhibitor, a desalination chemical and/or a biocide. The fluid may comprise another chemical, such as methanol. The fluid may comprise any other additive fluid or mixture or combination of additive fluids. The holding tank 58 may be used for long term storage of the fluid or for temporarily holding the fluid for injection. The holding tank 58 may comprise a single tank, multiple separate tanks, or multiple tanks in fluid communication via appropriate plumbing. The holding tank 58 may also comprise a single tank with multiple separate compartments or with compartments in fluid communication via appropriate plumbing, or baffles, for example.

The holding tank 58 may be comprised of a stationary tank, a mobile tank, a pressurized fluid source, such as a municipal water supply, or the like. As used herein, "holding tank 58" is not limited to a conventional fluid tank and may be comprised of any device, combination of devices, or system capable of providing fluid for injection by the multi-port injection system 10.

Preferably, the holding tank 58 will be of sufficient size to hold a significantly greater volume of the fluid than the first measuring tube 53 and the second measuring tube 63 described herein. Preferably, the holding tank 58 will be of sufficient size to hold a sufficient volume of the fluid to carry out multiple injection cycles, as described herein. For example, if eight injection cycles are to be carried out during a specified period of time, and each injection cycle requires a certain volume of fluid, the holding tank 58 will preferably be sized to hold a sufficient volume of the fluid to carry out all eight injection cycles without the need to add more fluid to the holding tank 58.

As shown in FIGS. 2-5, the holding tank 58 is fluidly coupled and is in fluid communication with a first fill valve 55 and a second fill valve 65 for providing a first portion of the fluid in the holding tank 58 to the first measuring tube 53 through the first fill valve 55, and a second portion of the fluid in the holding tank 58 to the second measuring tube 63 through the second fill valve 65, for use in first and second fluid injection cycles as described further herein. The holding tank 58 also provides additional portions of the fluid to the first measuring tube 53 and the second measuring tube 63 through the first fill valve 55 and the second fill valve 65 respectively for additional fluid injection cycles.

The holding tank 58 may have one fluid outlet or a plurality of fluid outlets and the same or different fluid outlets may be fluidly coupled and in fluid communication with one or both of the first fill valve 55 and the second fill valve 65.

The phrases "fluidly coupled" and "in fluid communication with" as used herein are meant to include both direct and indirect fluid coupling and communication. The coupling may be via various appropriate plumbing components and may include various intermediate devices and/or components.

F. Measuring Tubes.

As illustrated in FIGS. 2-5, the multi-port fluid injection system 10 also includes a first measuring tube 53 and a second measuring tube 63. The first measuring tube 53 is fluidly coupled and in fluid communication with a first fill valve 55 and with the holding tank 58 through the first fill valve 55. The second measuring tube 63 is fluidly coupled and in fluid communication with a second fill valve 65 and with the holding tank 58 through the second fill valve 65.

The first measuring tube 53 is adapted for receiving a first portion of the fluid from the holding tank 58 through the first fill valve 55 for use in a first fluid injection cycle. The second measuring tube 63 is adapted for receiving a second portion of the fluid from the holding tank 58 through the second fill valve 65 for use in a second fluid injection cycle. The first measuring tube 53 and the second measuring tube 63 are also adapted to receive additional portions of the fluid from the holding tank 58 through the first fill valve 55 and the second fill valve 65 respectively for use in additional fluid injection cycles.

The first measuring tube 53 holds the first portion of the fluid and provides it for injection by the multi-port fluid injection system 10 in a first fluid injection cycle as described further herein. The first measuring tube 53 also holds the first portion of the fluid for determining its level and volume. The second measuring tube 63 holds the second portion of the fluid from the holding tank 58 and provides it for injection by the multi-port fluid injection system 10 in a second fluid injection cycle as described further herein. The second measuring tube 63 also holds the second portion of the fluid for determining its level and volume.

As the first portion of the fluid in the first measuring tube 53 and the second portion of the fluid in the second measuring tube 63 are injected by the fluid injection system, the first measuring tube 53 and the second measuring tube 63 are adapted to receive additional portions of fluid from the holding tank 58 via the first fill valve 55 and the second fill valve 65 to replenish the fluid that was injected. The process by which this is accomplished allows the fluid injection system to carry out a series of fluid injection cycles continuously and without interruption for refilling fluid as described herein.

It is noted that although the first measuring tube 53 holds a first portion of the fluid for use in a first fluid injection cycle, and the second measuring tube 63 holds a second portion of the fluid for use in a second fluid injection cycle, during operation of the multi-port injection system 10 situations may arise where the volume of the first portion of the fluid and/or the volume of the second portion of the fluid is sufficient to carry out multiple fluid injection cycles. For example, if the volume of the first portion of the fluid is sufficient to carry out multiple fluid injection cycles, some or all of those fluid injection cycles may be carried out using the first portion of the fluid from the first measuring tube 53 before the second portion of the fluid is used for subsequent cycles. Similarly, if the volume of the second portion of the fluid is sufficient to carry out multiple fluid injection cycles, some or all of those fluid injection cycles may be carried out using the second portion of the fluid from the second measuring tube 63 before an additional portion of the fluid from the first measuring tube 53 is used for still further cycles.

Accordingly, it is understood that the use herein of "first" and "second" to describe the fluid injection cycles and the portions of the fluid are meant merely to differentiate between the cycles and to differentiate between the portions of the fluid, and are not intended to mean that the "first" and "second" cycles must occur in immediate succession, that the "first" portion of the fluid must be used exclusively for a single "first" fluid injection cycle, or that the "second" portion of the fluid must be used exclusively for a single "second" fluid injection cycle. The same applies with respect to subsequent fluid injection cycles that may be described using terms such as "third," "fourth," etc.

Figure 2:
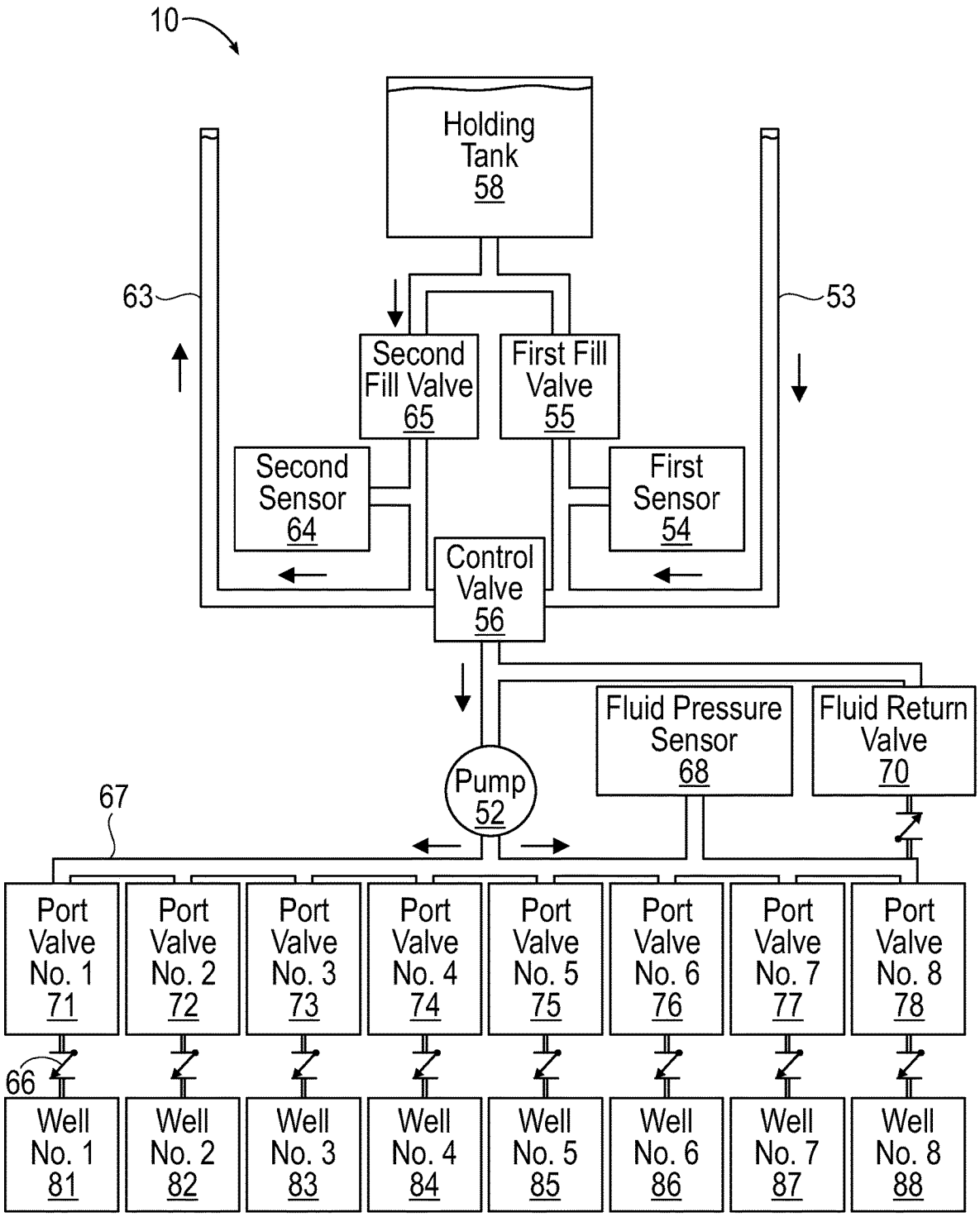
FIG. 2 is a block diagram showing the various components of a multi-port injection system and illustrating the flow of fluid from a first measuring tube to a plurality of port valves during a first fluid injection cycle in accordance with an example embodiment.
Figure 3:
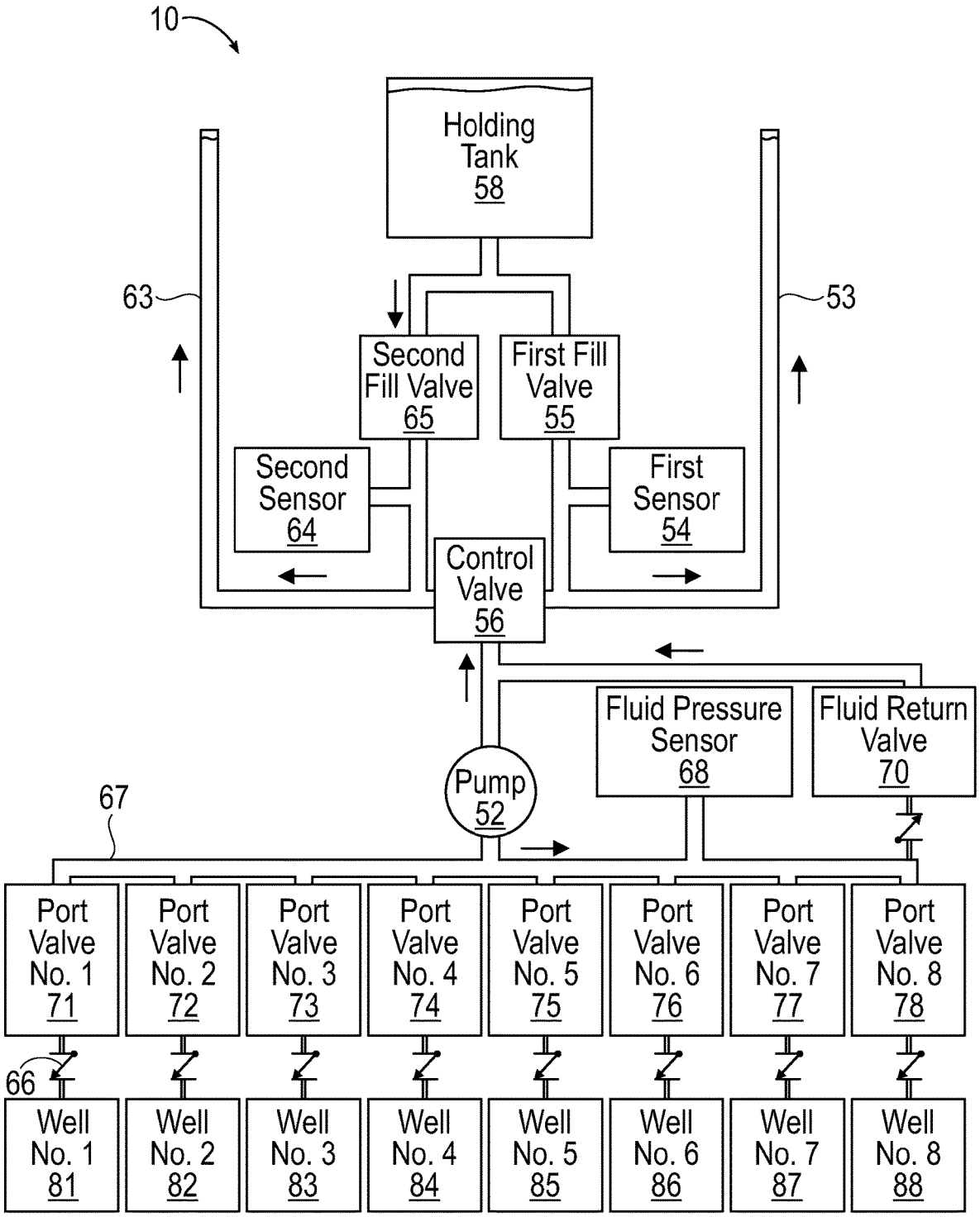
FIG. 3 is a block diagram showing the various components of a multi-port injection system and illustrating how fluid from a first measuring tube that was not injected prior to completion of a first fluid injection cycle is returned to the first measuring tube via a fluid return valve in accordance with an example embodiment.
Figure 4:
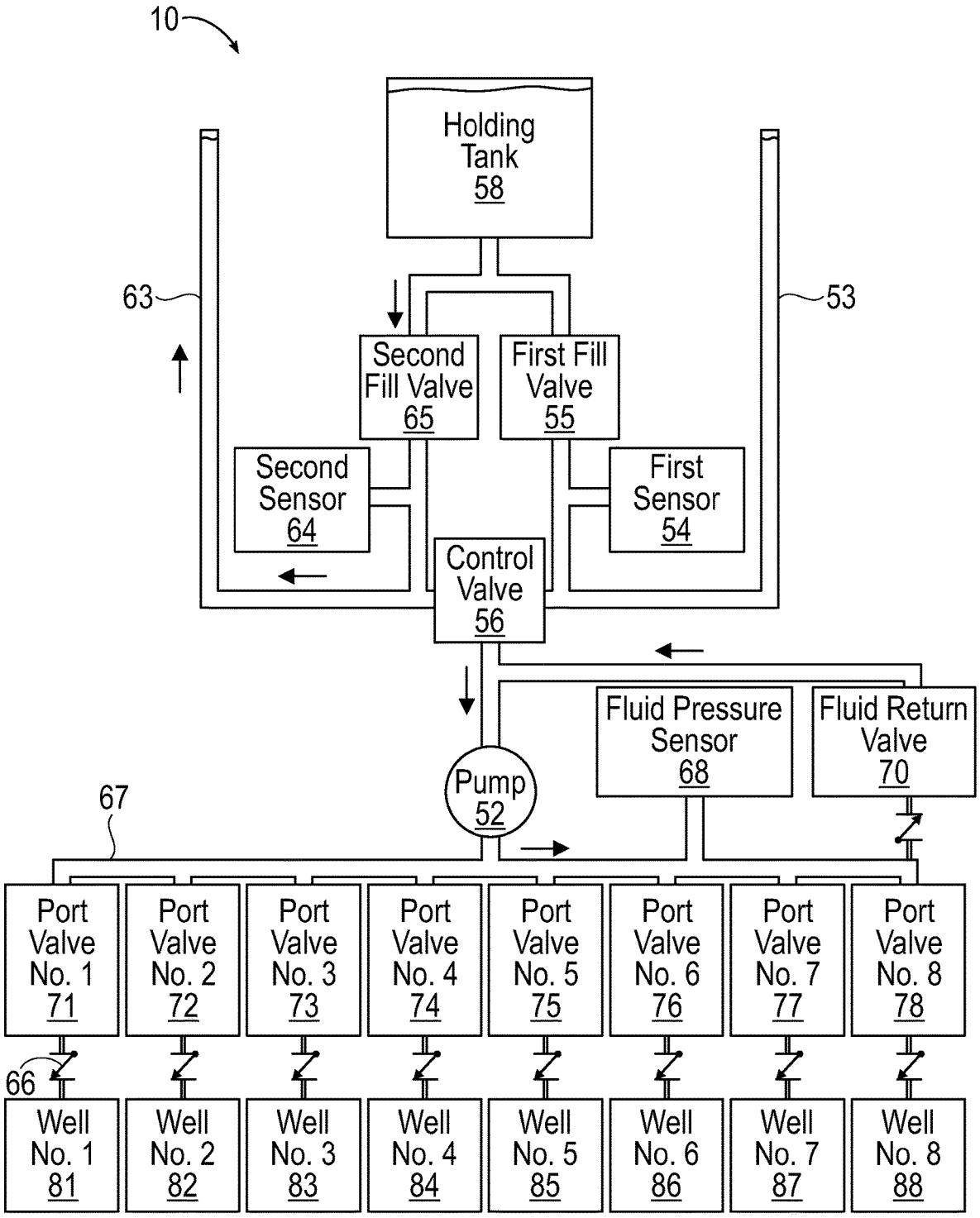
FIG. 4 is a block diagram showing the various components of a multi-port injection system and illustrating how the fluid in a first measuring tube following completion of a first fluid injection cycle and the return of fluid that was not injected is in a stable condition during a measurement of the fluid in accordance with an example embodiment.
Figure 5:
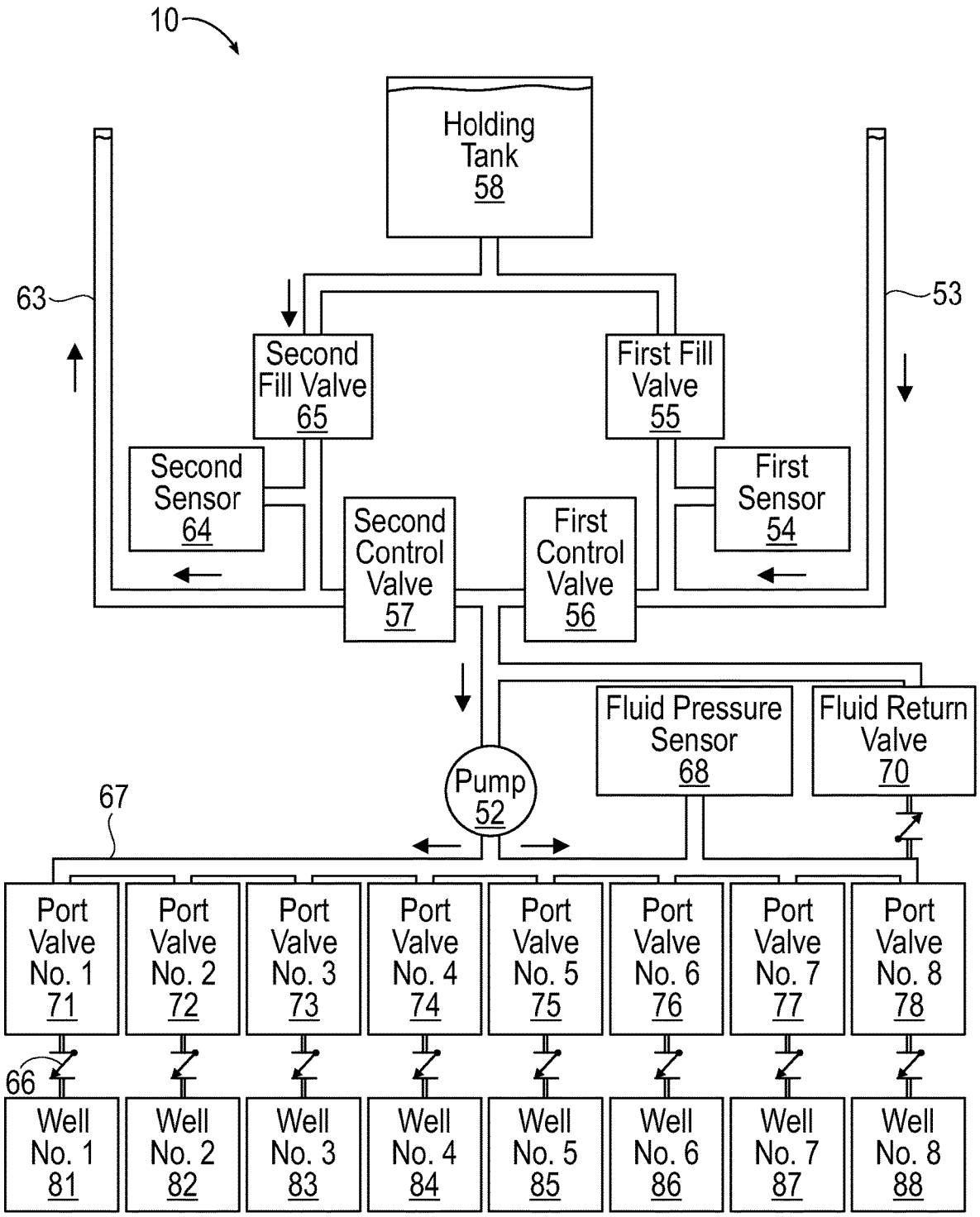
FIG. 5 is a block diagram showing the various components of a multi-port injection system and illustrating the flow of fluid from a first measuring tube to a plurality of port valves during a first fluid injection cycle in accordance with an alternative example embodiment.

As illustrated in FIGS. 2-4, each of the first measuring tube 53 and the second measuring tube 63 is also fluidly coupled and in fluid communication with a control valve 56, via the control valve 56 with a pump 52, and via the pump 52 with a manifold 67 and a plurality of port valves 71-78. Alternatively, as illustrated in FIG. 5, the first measuring tube 53 may be fluidly coupled and in fluid communication with a first control valve 56, via the first control valve 56 with the pump 52, and via the pump 52 with the manifold 67 and the plurality of port valves 71-78. Similarly, the second measuring tube 63 may be fluidly coupled and in fluid communication with a separate second control valve 57, via the second control valve 57 with the pump 52, and via the pump 52 with the manifold 67 and the plurality of port valves 71-78.

This intercoupling defines a fluid flow path for the first portion of the fluid in the first measuring tube 53 to be directed to the plurality of port valves 71-78 for injection to a plurality of injection points, such as wells 81-88, during a first fluid injection cycle. This intercoupling also provides a fluid flow path for the second portion of the fluid in the second measuring tube 63 to be directed to the plurality of port valves 71-78 for injection to a plurality of injection points, such as wells 81-88, during a second fluid injection cycle. The intercoupling also provides fluid flow paths for additional portions of the fluid in the first measuring tube 53 and the second measuring tube 63 to be directed to the plurality of port valves 71-78 for injection to a plurality of injection points during subsequent fluid injection cycles, e.g., third, fourth, etc. cycles.

Each of the first measuring tube 53 and the second measuring tube 63 is also fluidly coupled and in fluid communication with a fluid return valve 70 either via the shared control valve 56 (FIGS. 2-4) or separate first control valve 56 and second control valve 57 (FIG. 5), and via the fluid return valve 70 with the manifold 67 and the plurality of port valves 71-78. This intercoupling defines a fluid flow path by which the first portion of the fluid that was provided by the first measuring tube 53 for a first fluid injection cycle, but that was not actually injected during the first fluid injection cycle, can be returned to the first measuring tube 53. It also defines a fluid flow path by which the second portion of the fluid that was provided by the second measuring tube 63 for a second fluid injection cycle, but that was not actually injected during the second fluid injection cycle, can be returned to the second measuring tube 63. The same fluid flow paths provide for additional portions of the fluid provided by the first measuring tube 53 and the second measuring tube 63 for subsequent fluid injection cycles, e.g., third, fourth, etc. cycles, but that were not actually injected during the subsequent cycles, to be returned to the first measuring tube 53 and the second measuring tube 63, depending on which tube provided a particular additional portion of the fluid for a particular injection cycle.

The first measuring tube 53 is adapted to receive and hold the first portion of the fluid that was provided for a first fluid injection cycle, but that was not actually injected during the cycle and was returned to the first measuring tube 53, together with the first portion of the fluid that was not provided for the first fluid injection cycle and that remained in the first measuring tube 53 during the first fluid injection cycle. The second measuring tube 63 is also adapted to receive and hold the second portion of the fluid that was provided for a second fluid injection cycle, but that was not actually injected during the cycle and was returned to the second measuring tube 63, together with the second portion of the fluid that was not provided for the second fluid injection cycle and that remained in the second measuring tube 63. The first measuring tube 53 holds the combined remaining and returned first portion of the fluid for determining the level and volume of the fluid, and provides it for injection by the multi-port fluid injection system 10 in subsequent fluid injection cycles as described herein. The second measuring tube 63 holds the combined remaining and returned second portion of the fluid for determining its level and volume, and provides it for injection by the multi-port injection system 10 in subsequent fluid injection cycles as described herein.

The first measuring tube 53 and the second measuring tube 63 each preferably comprise a tube having an interior space with a volume sufficient to hold a portion of the fluid in the holding tank 58. Typically, the first measuring tube 53 and the second measuring tube 63 each is adapted to hold a volume of fluid significantly less than the volume of fluid the holding tank 58 can hold. The first measuring tube 53 and the second measuring tube 63 may have various shapes and sizes. As illustrated in in FIGS. 2-4, in an example preferred embodiment, the first measuring tube 53 and the second measuring tube 63 may be shaped as cylindrical tubes and arranged in an upright or substantially upright orientation. Alternatively, the first measuring tube 53 and the second measuring tube 63 may be configured to be upwardly slanting. Although the first and second measuring tubes typically will be identical and will have the ability to hold the same volume of fluid, they need not be. The first measuring tube 53 and the second measuring tube 63 may be as described in the present applicant's U.S. Pat. No. 10,144,653, particularly as described at Col. 6, lines 32-34 and lines 40-58. That patent is hereby incorporated by reference.

G. Fill Valves.

Also illustrated in FIGS. 2-5 are the first fill valve 55 and the second fill valve 65 of the multi-port fluid injection system 10. The first fill valve 55 is fluidly coupled between and is in fluid communication with the holding tank 58 and the first measuring tube 53. The second fill valve 65 is fluidly coupled between and is in fluid communication with the holding tank 58 and the second measuring tube 63. The first fill valve 55 and the second fill valve 65 each is in communication with the control unit 30.

Each of the first fill valve 55 and the second fill valve 65 may comprise any electronically controlled valve controllable by the control unit or another controller. Each of the first fill valve 55 and the second fill valve 65 has an open state in which fluid can flow through the valve and a closed state wherein fluid is prevented from flowing through the valve. Each of the first fill valve 55 and the second fill valve 65 is operable independently of the other and is controlled by the control unit 30 independently of the other.

Each of the first fill valve 55 and the second fill valve 65 is operable to transfer a portion of the fluid from the holding tank 58 to its respective first measuring tube 53 and second measuring tube 63. More specifically, the first fill valve 55 is operable to transfer a first portion of the fluid from the holding tank 58 to the first measuring tube 53 for use in a first fluid injection cycle. The second fill valve is operable to transfer a second portion of the fluid from the holding tank 58 to the second measuring tube 63 for use in a second fluid injection cycle.

The first fill valve 55 is also operable to transfer additional portions of the fluid from the holding tank 58 to the first measuring tube 53 to refill it and replenish the fluid that was injected during a previous fluid injection cycle. The second fill valve 65 is similarly operable to transfer additional portions of the fluid from the holding tank 58 to the second measuring tube 63 to refill it and replenish the fluid that was injected during a previous fluid injection cycle.

For example, after a first fluid injection cycle is completed, if the volume of the first portion of the fluid remaining in the first measuring tube 53 is insufficient to carry out a second fluid injection cycle, the second portion of the fluid in the second measuring tube 63 may be used for the second fluid injection cycle. The first fill valve 55 is operable to transfer a third portion of the fluid from the holding tank 58 to the first measuring tube 53 to refill it and replenish the first portion of the fluid that was used in the first fluid injection cycle. After the second fluid injection cycle is completed, if the volume of the second portion of the fluid remaining in the second measuring tube 63 is insufficient to carry out a third fluid injection cycle, the third portion of the fluid in the first measuring tube 53 may be used for the third fluid injection cycle. The second fill valve 65 is operable to transfer a fourth portion of the fluid from the holding tank 58 to the second measuring tube 63 to refill it and replenish the third portion of the fluid that was used in the second fluid injection cycle, and so on.

The first fill valve 55 and the second fill valve 65 are thus operable to transfer portions of the fluid from the holding tank 58 to the first measuring tube 53 and the second measuring tube 63 respectively for the multi-port fluid injection system 10 to carry out initial first and second fluid injection cycles. The first fill valve 55 and the second fill valve 65 are subsequently operable to transfer additional (third, fourth, etc.) portions of the fluid from the holding tank 58 to the first measuring tube 53 and the second measuring tube 63 in alternating fashion to refill or replenish the portions of the fluids used in previous fluid injection cycles. This enables the multi-port fluid injection system 10 to carry out a series of fluid injection cycles continuously and without interruption for refilling fluid.

Of course, it is understood that if the first portion of the fluid or any additional portion of the fluid subsequently transferred to the first measuring tube 53 is sufficient for the multi-port injection system 10 to carry out multiple fluid injection cycles, the first fill valve 55 is operable to transfer an additional portion of the fluid to the first measuring tube 53 once those fluid injection cycles are carried out and it is determined the first portion of the fluid or any additional portion of the fluid remaining in the first measuring tube 53 is not sufficient for a subsequent fluid injection cycle. It is also understood that if the second portion of the fluid or any additional portion of the fluid subsequently transferred to the second measuring tube 63 is sufficient for the multi-port injection system 10 to carry out multiple fluid injection cycles, the second fill valve 65 is operable to transfer an additional portion of the fluid to the second measuring tube 63 once those fluid injection cycles are carried out and it is determined the second portion of the fluid or any additional portion of the fluid remaining in the second measuring tube 63 is not sufficient for a subsequent fluid injection cycle.

Preferably, each of the first fill valve 55 and the second fill valve 65 is connected in line between the holding tank 58 and its respective first measuring tube 53 and second measuring tube 63. This allows the first fill valve 55 and the second fill valve 65 to transfer the fluid from the holding tank 58 to the first measuring tube 53 and the second measuring tube 63 under the force of gravity. Pumps or other sources of motive force may also be used.

H. Measuring Tube Sensors.

As illustrated in FIGS. 2-5, the multi-port fluid injection system 10 also includes a first sensor 54 coupled to the first measuring tube 53 and a second sensor 64 coupled to the second measuring tube 63. Each of the first sensor 54 and the second sensor 64 is in communication with the control unit 30.

Each of the first sensor 54 and the second sensor 64 preferably comprises a pressure sensor. The first sensor 54 is preferably fluidly coupled and in fluid communication with the first measuring tube 53. The second sensor 64 is preferably fluidly coupled and in fluid communication with the second measuring tube 63.

The first sensor 54 is operable to determine an indication of the volume of the fluid in the first measuring tube 53. Thus, for example, the first sensor 54 is operable to provide an indication of the volume of the first portion of the fluid in the first measuring tube 53 that was transferred from the holding tank 58 prior to a first fluid injection cycle being carried out. The first sensor 54 is also operable to determine an indication of the volume of the fluid in the first measuring tube 53 after the first injection cycle has been completed, the fluid being comprised of the first portion of the fluid that remained in the first measuring tube 53 and was not provided for the first fluid injection cycle, and the first portion of the fluid that was provided for the first fluid injection cycle but that was not actually injected during the cycle and was returned to the first measuring tube 53. The first sensor 54 also is operable to determine an indication of the volume of additional portions of the fluid in the first measuring tube 53 prior to and following completion of subsequent fluid injection cycles.

The second sensor 64 also is operable to determine an indication of the volume of the fluid in the second measuring tube 63. Thus, for example, the second sensor 64 is operable to provide an indication of the volume of the second portion of the fluid in the second measuring tube that was transferred from the holding tank 58 prior to a second fluid injection cycle being carried out. The second sensor 64 is also operable to determine an indication of the volume of fluid in the second measuring tube 63 after the second injection cycle has been completed, the fluid being comprised of the second portion of the fluid that remained in the second measuring tube 63 and was not provided for the second fluid injection cycle, and the second portion of the fluid that was provided for the second fluid injection cycle but that was not actually injected during the cycle and was returned to the second measuring tube 63. The second sensor 64 also is operable to determine an indication of the volume of additional portions of the fluid in the second measuring tube 63 prior to and following completion of subsequent fluid injection cycles.

The level of the fluid in the first measuring tube 53 and the level of the fluid in the second measuring tube 63 provide one indication of the volume of the fluid in the first measuring tube 53 and the second measuring tube 63 respectively. The level of the fluid in a measuring tube may be derived from the pressure the fluid in the measuring tube exerts on a pressure sensor. Thus, the level of the fluid in the first measuring tube 53 may be determined from the pressure the fluid in the first measuring tube exerts on the first sensor 54 and the level of the fluid in the second measuring tube 63 may be determined from the pressure the fluid in the second measuring tube exerts on the second sensor 64.

The volume of the fluid in the first measuring tube 53 and the volume of the fluid in the second measuring tube 63 each may be derived from the level of the fluid in the respective measuring tube, the known dimensions of the measuring tube, and the known properties of the fluid. The level of the fluid in the measuring tube thus provides an indication of the volume of the fluid in the measuring tube.

Each of the first sensor 54 and the second sensor 64 is preferably fluidly connected to a bottom or lower portion of the respective first measuring tube 53 and the second measuring tube 63, or is fluidly connected below the respective measuring tube to acquire an accurate reading of the total volume of the fluid in the measuring tube.

Each of the first sensor 54 and the second sensor 64 may transmit an indication of the fluid level or volume to the control unit 30 either periodically, continuously, or upon request of the control unit 30.

Although the first sensor 54 and the second sensor 64 are preferably pressure sensors, those skilled in the art will appreciate that other types of sensors are also operable to provide an indication of the volume of fluid in a tube and may be used in place of or in addition to pressure sensors for the first sensor 54 and second sensor 64. Such sensors may include, for example, optical sensors, capacitive sensors, and other types of mechanical sensors. The first sensor 54 and the second sensor 64 will typically be of the same sensor type, but may be of different types.

I. Control Valve.

In one example embodiment illustrated in FIGS. 2-4, the multi-port injection system 10 also includes a control valve 56. In this example embodiment, the control valve 56 comprises a directional control valve, more specifically a three-port directional control valve, and is effectively shared between the first measuring tube 53 and the second measuring tube 63. In an alternative example embodiment illustrated in FIG. 5, the multi-port injection system 10 includes a separate first control valve 56 and a separate second control valve 57. In this example embodiment, each of the first control valve 56 and the second control valve 57 comprises a two-port valve, and each of the first control valve 56 and the second control valve 57 is effectively dedicated to the first measuring tube 53 and the second measuring tube 63 respectively. The control valves 56 and 57 may comprise any electronically controlled valve controllable by the control unit 30 or another controller. The control valves 56 and 57 are in communication with the control unit 30.

In the example embodiment illustrated in FIGS. 2-4, the control valve 56 is fluidly coupled and in fluid communication with the first measuring tube 53, the second measuring tube 63, the pump 52, and the fluid return valve 70. The control valve 56 of the example embodiment has three ports, a first port fluidly coupled to the first measuring tube 53, a second port fluidly coupled to the second measuring tube 63, and a third port fluidly coupled via the pump 52 to the manifold 67 and via the manifold 67 to the plurality of port valves 71-78 and the fluid return valve 70.

In the alternative example embodiment illustrated in FIG. 5, the first control valve 56 is fluidly coupled and in fluid communication with the first measuring tube 53, the pump 52, and the fluid return valve 70. The first control valve 56 has two ports, a first port fluidly coupled to the first measuring tube 53 and a second port fluidly coupled to the manifold 67 and via the manifold 67 to the plurality of port valves 71-78 and the fluid return valve 70. The second control valve 57 is fluidly coupled and in fluid communication with the second measuring tube 63, the pump 52, and the fluid return valve 70. The second control valve 57 has two ports, a first port fluidly coupled to the first measuring tube 53 and a second port fluidly coupled to the manifold 67 and via the manifold 67 to the plurality of port valves 71-78 and the fluid return valve 70.

In the example embodiment illustrated in FIGS. 2-4, the control valve 56 has a first state in which fluid can flow through the valve between the first measuring tube 53 and the pump 52, and between the fluid return valve 70 and the first measuring tube 53, i.e., between the first port and the third port. The control valve 56 has a second state in which fluid can flow through the valve between the second measuring tube 63 and the pump 52, and between the fluid return valve 70 and the second measuring tube 63, i.e., between the second port and the third port. In each of the first state and the second state, the fluid may flow through the control valve between the ports bidirectionally.

In the alternative example embodiment illustrated in FIG. 5, each of the first control valve 56 and the second control valve 57 has a first state in which fluid can flow bidirectionally through the valve between the first and second ports and a second state in which fluid is blocked from flowing through the valve. When the first control valve is in the first state, fluid can flow through the first control valve 56 from the first measuring tube 53 to the pump 52, and from the fluid return valve 70 to the first measuring tube 53. When the second control valve 57 is in the first state, fluid can flow through the second control valve 57 from the second measuring tube 63 to the pump 52, and from the fluid return valve 70 to the second measuring tube 63.

In the example embodiment illustrated in FIGS. 2-4, the control valve 56 is operable to direct the first portion of the fluid from the first measuring tube 53 to the pump 52 during the first fluid injection cycle, and to direct the first portion of the fluid that was not injected during the first fluid injection cycle from the fluid return valve 70 to the first measuring tube 53 after the first fluid injection cycle is completed. Similarly, the control valve 56 is operable to direct the second portion of the fluid from the second measuring tube 63 to the pump 52 during the second fluid injection cycle, and to direct the second portion of the fluid that was not injected during the second fluid injection cycle from the fluid return valve 70 to the second measuring tube 63 after the second fluid injection cycle is completed.

In the alternative example embodiment illustrated in FIG. 5, the first control valve 56 is operable to direct the first portion of the fluid from the first measuring tube 53 to the pump 52 during the first fluid injection cycle, and to direct the first portion of the fluid that was not injected during the first fluid injection cycle from the fluid return valve 70 to the first measuring tube 53 after the first fluid injection cycle is completed. Similarly, the second control valve 57 is operable to direct the second portion of the fluid from the second measuring tube 63 to the pump 52 during the second fluid injection cycle, and to direct the second portion of the fluid that was not injected during the second fluid injection cycle from the fluid return valve 70 to the second measuring tube 63 after the second fluid injection cycle is completed.

Further, in the example embodiment illustrated in FIGS. 2-4, the control valve 56 is operable to direct additional portions of the fluid from the first measuring tube 53 and the second measuring tube 63 to the pump 52 in an alternating fashion for subsequent fluid injection cycles. Still further, the control valve 56 is operable to direct an additional portion of the fluid that was provided for a subsequent fluid injection cycle, but that was not actually injected during the cycle, from the fluid return valve 70 to the first measuring tube 53 or the second measuring tube 63 after each subsequent fluid injection cycle is completed. The control valve is operable to direct the additional portion of the fluid that was not actually injected to the first fluid measuring tube 53 and the second fluid measuring tube 63 in an alternating fashion depending on which measuring tube provided the additional portion of the fluid.

Similarly in the alternative example embodiment illustrated in FIG. 5, the first control valve 56 and the second control valve 57 are operable to direct additional portions of the fluid from the first measuring tube 53 and the second measuring tube 63 respectively to the pump 52 in an alternating fashion for subsequent fluid injection cycles. The first control valve 56 also is operable to direct an additional portion of the fluid that was provided from the first measuring tube 53 for a subsequent fluid injection cycle but that was not actually injected during the cycle, from the fluid return valve 70 back to the first measuring tube 53 after the subsequent fluid injection cycle is completed. The second control valve 57 also is operable to direct an additional portion of the fluid that was provided from the second measuring tube 63 for a subsequent fluid injection cycle but that was not actually injected during the cycle, from the fluid return valve 70 back to the second measuring tube 63 after the subsequent fluid injection cycle is completed. The first control valve 56 and the second control valve 57 are operable to direct the additional portion of the fluid that was not actually injected during a subsequent fluid injection cycle to the first fluid measuring tube 53 and the second fluid measuring tube 63 in an alternating fashion depending on which measuring tube provided the additional portion of the fluid for the subsequent fluid injection cycle.

J. Port Valves.

The multi-port injection system 10 includes a plurality of port valves 71-78 as illustrated in FIGS. 2-5. Although eight port valves 71-78 are illustrated, that number is merely for example and it will be appreciated that a greater or lesser number of port valves may be included without deviating from the concept or scope of the invention.

Each port valve of the plurality of port valves 71-78 may comprise any electronically controlled valve controllable by the control unit 30 or another controller. Each port valve of the plurality of port valves 71-78 is in communication with the control unit 30.

Each port valve of the plurality of port valves 71-78 is adapted to be fluidly coupled to a fluid injection port into which the multi-port injection system 10 is to inject a fluid. Numerous connectors suitable for this purpose are known to those skilled in the art and are therefore not described in detail herein. Suitable connectors can include various threaded-type connectors, various lever-actuated connectors, various quick-release connectors, various bayonet-type connectors, etc.

Each port valve of the plurality of port valves 71-78 is operable to be in an open state and in a closed state. In the open state, the port valve allows fluid to flow through the valve to the fluid injection port to which it is coupled. In the closed state, the port valve prevents fluid from flowing through the valve.

Each fluid injection port of the plurality of fluid injection ports comprises a fluid injection port of a fluid injection point, such as wells 81-88. While wells 81-88 are illustrated as examples of fluid injection points with which the multi-port injection system 10 may be used, the injection points may be any facility that requires an injection of fluid for whatever reason. For example, injection points may comprise oil or gas wells, compressor stations, or lines.

A plurality of check valves 66 is preferably included. Each check valve of the plurality of check valves 66 is fluidly coupled to and between a port valve of the plurality of port valves 71-78 and a fluid injection port of the plurality of fluid injection points 81-88 to which the port valve is coupled. Each check valve is operable and configured to prevent backflow of fluid from the fluid injection port to and through the port valve to which it is coupled.

K. Pump.

As illustrated in FIGS. 2-5, the multi-port injection system 10 includes pump 52. The pump 52 is in communication with the control unit 30 and is a type that may be electronically controlled by the control unit 30 or another control device.

In the example embodiment illustrated in FIGS. 2-4, the pump 52 is fluidly coupled and in fluid communication with the control valve 56 and via the control valve 56 with the first measuring tube 53 and the second measuring tube 63. In the alternative example embodiment illustrated in FIG. 5, the pump 52 is fluidly coupled and in fluid communication with both the first control valve 56 and the second control valve 57, via the first control valve 56 with the first measuring tube 53, and via the second control valve 57 with the second measuring tube 63. The pump 52 is also fluidly coupled with the manifold 67 and via the manifold 67 with the plurality of port valves 71-78. In the example embodiment illustrated in FIGS. 2-4, the pump 52 has an intake that is fluidly coupled to a port of the control valve 56. In the alternative example embodiment of FIG. 5, the intake of the pump 52 is fluidly coupled to a port of both the first control valve 56 and the second control valve 57. In both embodiments, the pump 52 has an outlet that is fluidly coupled to an inlet of the manifold 67.

The pump 52 is operable to pump fluid from the first measuring tube 53 and from the second measuring tube 63 to the plurality of port valves 71-78 for injection into the plurality of fluid injection ports of the plurality of injection points, such as wells 81-88. Thus, the pump 52 is operable to pump a first portion of the fluid from the first measuring tube 53 to a first port valve of the plurality of port valves 71-78 for injection into a first fluid injection port of the plurality of fluid injection ports during a first fluid injection cycle. The pump 52 also is operable to pump a second portion of the fluid from the second measuring tube 63 to a second port valve of the plurality of port valves 71-78 for injection into a second fluid injection port of the plurality of fluid injection ports during a second fluid injection cycle. The pump 52 is further operable to pump additional portions of the fluid from the first measuring tube 53 and the second measuring tube 63 to additional port valves of the plurality of port valves 71-78 for injection into additional fluid injection ports during subsequent fluid injection cycles.

The manifold 67 is fluidly coupled between the pump 52 and the plurality of port valves 71-78 for conducting fluid from the pump 52 to each port valve of the plurality of port valves 71-78 for injection into an injection port of the plurality of injection ports. Thus, the manifold 67 is operable to conduct a first portion of the fluid to be injected during a first fluid injection cycle between the pump 52 and the plurality of port valves 71-78 for injection into a selected injection port, and a second portion of the fluid to be injected during a second fluid injection cycle between the pump 52 and the plurality of port valves 71-78 for injection into another selected injection port. The manifold is also operable to conduct additional portions of fluid to be injected during subsequent fluid injection cycles between the pump 52 and the plurality of port valves 71-78 for injection into other selected injection ports.

The pump 52 is fluidly coupled and in fluid communication with the fluid return valve 70 via the manifold 67, which is fluidly coupled between the pump 52 and the fluid return valve 70. The pump is also fluidly coupled and in fluid communication with a fluid pressure sensor 68 via the manifold 67. The fluid return valve 70 and the fluid pressure sensor 68 are further described in subsequent sections.

Following the completion of a fluid injection cycle the operation of the pump 52 is not required to return a portion of fluid that was not actually injected during the fluid injection cycle to the respective first measuring tube 53 or second measuring tube 63 that provided it for the fluid injection cycle. Simply opening the fluid return valve 70 and the control valve 56 will cause the portion of fluid that was not injected to return to the respective first measuring tube 53 or second measuring tube 63 that provided it as a result of the pressure differential between the port valves 71-76 and manifold 67 and the respective measuring tube. If desired, however, the pump 52 may be left running during the fluid return phase to avoid having to repeatedly activate and deactivate it, which could possibly result in premature wear and damage to the pump 52. If the pump 52 is left running during the fluid return phase, it will pump the portion of the fluid that was not actually injected during the fluid injection cycle in a closed loop that includes the fluid return valve 70 and the first measuring tube 53 or second measuring tube 63 (depending on the state of the control valve 56), but will not interfere with the return of the portion of the fluid that was not injected to the respective first measuring tube 53 or second measuring tube 63 that provided it.

The pump 52 need not be a conventional pump and may be comprised of any device capable and adapted to move a volume of fluid to be injected from the first measuring tube 53 and the second measuring tube 63 to and through the plurality of port valves 71-78 for injection into a plurality of fluid injection ports of injection points, such as wells 81-88, gas compressor stations, gas lines, or other injection points, as described herein. In addition, although FIGS. 2-5 show a single pump 52 for illustrative purposes, those skilled in the art will appreciate that a plurality of pumps arranged in series, in parallel, or a combination of both may be employed as pump 52. In connection with the alternative example embodiment illustrated in FIG. 5, for example, a separate pump may be separately fluidly coupled with each of the first control valve 56 and the second control valve 57.

The pump 52 should be capable of pumping fluid at sufficient pressures and over a suitable range of pressures to inject the fluid through the fluid injection ports of a plurality of injection points having different pressure requirements and characteristics. For example, in an embodiment for injecting fluid into oil wells, the pump may be required to pump the fluid at a pressure in excess of 1300 psi for one well and at a pressure of 150 psi or lower for another well.

L. Fluid Return Valve.

As illustrated in FIGS. 2-5, the multi-port injection system 10 includes a fluid return valve 70. The fluid return valve 70 may be any valve that is operable to return fluid that was not injected during a fluid injection cycle to the first measuring tube 53 and the second measuring tube 63, depending on which measuring tube provided the fluid for the injection cycle. In a particular preferred embodiment, the fluid return valve 70 comprises a pressure relief valve.

The fluid return valve 70 may comprise any suitable electronically controlled valve that is controllable by the control unit 30 or another controller. The fluid return valve 70 is in communication with the control unit 30.

The fluid return valve 70 is fluidly coupled and in fluid communication with the pump 52. In the example embodiment illustrated in FIGS. 2-4, the fluid return valve 70 is also fluidly coupled with and in fluid communication with the control valve 56, and via the control valve 56 with the first measuring tube 53 and the second measuring tube 63. In the alternative example embodiment illustrated in FIG. 5, the fluid return valve 70 is also fluidly coupled with and in fluid communication with the first control valve 56 and the second control valve 57, via the first control valve 56 with the first measuring tube 53, and via the second control valve 57 with the second measuring tube 63. The fluid return valve 70 is also fluidly coupled and in fluid communication with the manifold 67, and via the manifold 67 the plurality of port valves 71-78.

The fluid return valve 70 is fluidly coupled between the plurality of port valves 71-78 and the first measuring tube 53, and between the plurality of port valves 71-78 and the second measuring tube 63. The fluid return valve 70 is also fluidly coupled between the manifold 67 and the first measuring tube 53, and between the manifold 67 and the second measuring tube 63.

The fluid return valve 70 is operable to be in an open state and in a closed state. In the open state, fluid is able to flow through the fluid return valve 70. In the closed state, fluid is blocked from flowing through the fluid return valve 70.

Following the completion of a fluid injection cycle, the fluid return valve 70 is operable to return the portion of the fluid that was provided from the first measuring tube 53 for the fluid injection cycle, but that was not actually injected during the cycle, to the first measuring tube 53. More particularly, the fluid return valve 70 is operable to return the portion of the fluid in the manifold 67 that was not injected during the fluid injection cycle to the first measuring tube 53.

Similarly following the completion of a fluid injection cycle, the fluid return valve 70 is operable to return the portion of the fluid that was provided from the second measuring tube 63 for the fluid injection cycle, but that was not actually injected during the cycle, to the second measuring tube 63. More particularly, the fluid return valve 70 is operable to return the second portion of the fluid in the manifold 67 that was not injected during the second fluid injection cycle to the second measuring tube 63.

More particularly, following the completion of a first fluid injection cycle, the fluid return valve 70 is operable to return the first portion of the fluid that was provided by the first measuring tube 53, but that was not injected during the first fluid injection cycle, to the first measuring tube 53. This includes the fluid return valve 70 being operable to return the first portion of the fluid in the manifold 67 that was not injected during the first fluid injection cycle to the first measuring tube 53. Following a second fluid injection cycle, the fluid return valve 70 is operable to return the second portion of the fluid that was provided by the second measuring tube 63, but that was not injected during the second fluid injection cycle, to the second measuring tube 63. This includes the fluid return valve 70 being operable to return the second portion of the fluid in the manifold 67 that was not injected during the second fluid injection cycle to the second measuring tube 63.

Following subsequent fluid injection cycles, e.g., third, fourth, etc., the fluid return valve 70 is operable to return each additional portion of the fluid that was provided by the first measuring tube 53 and the second measuring tube 63 for injection, but that was not actually injected, to the first measuring tube 53 and the second measuring tube 63, depending on which measuring tube provided the particular additional portion of the fluid for the particular subsequent fluid injection cycle. In each instance, the fluid return valve 70 is operable to return the additional portion of the fluid in the manifold 67 that was not injected to the measuring tube that provided it.

It should be apparent from the description herein that upon completion of a fluid injection cycle, a certain volume of excess fluid that was not actually injected prior to the completion of the cycle may remain in various components of the system, including the manifold 67. This can occur for a variety of reasons. Further, any excess fluid remaining may still be under the pressure at which the fluid injection cycle was carried out. If the pressure was relatively high, say about 1300 psi, and the next fluid injection cycle is to be carried out at a substantially lower pressure, say about 150 psi, then when the next fluid injection cycle is initiated, the excess fluid remaining from the previous higher-pressure fluid injection cycle will instead be injected during the subsequent lower-pressure fluid injection cycle.

This presents a problem for accurately measuring the volume of fluid that was actually injected into each fluid injection port during a series of fluid injection cycles. Because fluid that was measured as having been injected into one port was actually injected into another port, the measured volumes of the fluids injected into both ports are wrong. One is effectively "over-counted" and the other is effectively "under-counted." Over a number of injection cycles, a very large deviation can develop in the accuracy of the measured volumes of the fluids injected on a port-to-port basis.

By operating the fluid return valve 70 following completion of a fluid injection cycle to place it in the open state, any high pressure remaining in the system, including at the port valves 71-78 and in the manifold 67, can be released prior to initiating a subsequent fluid injection cycle. This ensures that the excess fluid remaining in the system is not inadvertently injected into the wrong fluid injection port during the subsequent fluid injection cycle. Further, since the first measuring tube 53 and the second measuring tube 63 will typically be at approximately atmospheric pressure, the excess fluid remaining flows through the fluid return valve 70 under the force of the pressure of the fluid in the manifold 67 relative to the pressure of the fluid in the measuring tubes, i.e., the pressure differential, and is returned to the measuring tube that provided it. By determining the volume of the fluid in the measuring tube after the excess fluid is returned, as described herein, the multi-port injection system 10 is able to provide a very accurate determination of the volume of fluid that was actually injected into each fluid injection port of a plurality of fluid injection ports during each of a series fluid injection cycles.

M. Fluid Pressure Sensor.

The multi-port injection system 10 also includes a fluid pressure sensor 68 as illustrated in FIGS. 2-5. The fluid pressure sensor 68 is in communication with the control unit 30. The fluid pressure sensor may transmit an indication of fluid pressure to the control unit 30 either periodically, continuously, or upon request of the control unit 30.

The fluid pressure sensor 68 is fluidly coupled and in fluid communication with the manifold 67, and via the manifold 67 with the pump 52 and the plurality of port valves 71-78. The fluid pressure sensor 68 is operable to provide an indication of the pressure a fluid is under at the plurality of port valves 71-78 and in the manifold 67.

More particularly, following the completion of a fluid injection cycle using a portion of the fluid from the holding tank 58 during which some of the portion of the fluid was not injected, the fluid pressure sensor 68 is operable to provide an indication of the pressure the portion of the fluid that was not injected is under at the plurality of port valves 71-78 and in the manifold 67. Still more particularly, following the completion of a first fluid injection cycle using a first portion of the fluid from the first measuring tube 53 during which some of the first portion of the fluid was not injected, the fluid pressure sensor 68 is operable to provide an indication of the pressure the first portion of the fluid at the plurality of port valves 71-78 and in the manifold 67 is under. Similarly, following the completion of a second fluid injection cycle using a second portion of the fluid from the second measuring tube 63 during which some of the second portion of the fluid was not injected, the fluid pressure sensor 68 is operable to provide an indication of the pressure the second portion of the fluid at the plurality of port valves 71-78 and in the manifold 67 is under. Also similarly, following the completion of additional fluid injection cycles using additional portions of the fluid from the first measuring tube 53 and the second measuring tube 63, during which some of the additional portions of the fluid were not injected, the fluid pressure sensor 68 is operable to provide an indication of the pressures the additional portions of the fluid at the plurality of port valves 71-78 and in the manifold 67 are under.

The indication of the pressure a fluid that was not injected during a fluid injection cycle is under that the fluid pressure sensor 68 provides may be used by the control unit 30 to control the fluid return valve 70 and the control valve 56 (FIGS. 2-4) or first control valve 56 and second control valve 57 (FIG. 5) to cause the fluid to be returned to the first measuring tube 53 or second measuring tube 63, whichever provided it for the fluid injection cycle, as described herein.

N. Control Unit.

As illustrated in FIG. 1, the multi-port injection system 10 includes a control unit 30. The control unit 30 may be comprised of any type of computer for practicing the various aspects of the multi-port injection system. For example, the control unit 30 can be a personal computer (e.g. APPLE® based computer, an IBM based computer, or compatible thereof) or tablet computer (e.g. IPAD®). The control unit 30 may also be comprised of various other electronic devices capable of sending and receiving electronic data including but not limited to smartphones, mobile phones, telephones, personal digital assistants (PDAs), mobile electronic devices, handheld wireless devices, two-way radios, smart phones, communicators, video viewing units, television units, television receivers, cable television receivers, pagers, communication devices, and digital satellite receiver units. Further, the control unit 30 may comprise one or more microcontrollers, digital, analog, or mixed circuits, software, firmware, and internal or external configuration elements, such as programming, code, macros, and the like.

The control unit 30 is in communication with the first fill valve 55, the second fill valve 65, the first sensor 54, the second sensor 64, the control valve 56 (FIGS. 2-4), the first control valve 56 and the second control valve 57 (FIG. 5), the pump 52, the plurality of port valves 71-78, the fluid return valve 70, and the fluid pressure sensor 68. The control unit may also be in communication with a temperature sensor 42.

The control unit 30 is configured to control the first fill valve 55 and the second fill valve 65 to place each valve in the open state, wherein fluid is able to flow through the valve, and in the closed state wherein fluid is prevented from flowing through the valve. The control unit 30 is configured to operate each of the first fill valve 55 and the second fill valve 65 independently of the other. The control unit 30 may operate the first fill valve 55 and the second fill valve 65 simultaneously or at different times.

The control unit 30 is configured to operate the first fill valve 55 and the second fill valve 65 to transfer a desired volume of fluid from the holding tank 58 to the first measuring tube 53 and to the second measuring tube 63 respectively. The control unit 30 does this by controlling the first fill valve 55 and/or the second fill valve 65 to place the valve or valves in the open state in which fluid from the holding tank 58 flows through the valve or valves to the first measuring tube 53 and/or to the second measuring tube 63. Once a desired volume of fluid has been transferred, the control unit 30 controls the first fill valve 55 and/or the second fill valve 65 to place the valve or valves in the closed state.

The control unit 30 is configured to operate the first fill valve 55 to transfer portions of the fluid from the holding tank 58 to the first measuring tube 53 for injection during fluid injection cycles. More particularly, the control unit 30 is configured to operate the first fill valve 55 to transfer a first portion of the fluid for a first fluid injection cycle, and additional portions of fluid for subsequent fluid injection cycles. For example, the control unit 30 is configured to operate the first fill valve 55 to transfer a third portion of the fluid to the first measuring tube 53 for use in a third fluid injection cycle following completion of a first fluid injection cycle and a second fluid injection cycle.

Similarly, the control unit 30 is configured to operate the second fill valve 65 to transfer portions of the fluid from the holding tank 58 to the second measuring tube 63 for injection during fluid injection cycles. More particularly, the control unit 30 is configured to operate the second fill valve 65 to transfer a second portion of the fluid for a second fluid injection cycle, and additional portions of fluid for subsequent fluid injection cycles. For example, the control unit 30 is configured to operate the second fill valve 65 to transfer a fourth portion of the fluid to the second measuring tube 63 for use in a fourth fluid injection cycle following completion of first, second, and third fluid injection cycles.

The control unit 30 may be configured and/or programmed to carry out an initial fill operation. In the initial fill operation, the control unit 30 operates the first fill valve 55 and the second fill valve 65 simultaneously to simultaneously transfer a first portion of the fluid from the holding tank 58 to the first measuring tube 53 and a second portion of the fluid from the holding tank 58 to the second measuring tube 63 for use in a first fluid injection cycle and a second fluid injection cycle. The initial fill operation may be and preferably is carried out before any fluid injection cycles are initiated.

Following the initial fill operation, the control unit 30 may operate the first fill valve 55 and the second fill valve 65 in alternating fashion to refill the first measuring tube 53 and the second measuring tube 63 with additional portions of fluid from the holding tank 58 as fluid injection cycles are carried out and the portions of the fluid in the first measuring tube 53 and the second measuring tube 63 are injected and depleted. For example, following completion of a first fluid injection cycle using a first portion of the fluid from the first measuring tube 53, if the volume of the first portion of the fluid remaining in the first measuring tube 53 is insufficient to carry out a second fluid injection cycle, a second portion of the fluid from the second measuring tube 63 may be used for the second fluid injection cycle. While the second fluid injection cycle is being carried out, the control unit 30 operates the first fill valve 55 to transfer a third portion of the fluid from the holding tank 58 to the first measuring tube 53 to replenish the fluid that was used in the first fluid injection cycle and refill the first measuring tube 53. After completion of the second fluid injection cycle, if the volume of the second portion of the fluid remaining in the second measuring tube 63 is insufficient to carry out a third fluid injection cycle, the third portion of the fluid from the first measuring tube 53 may be used for the third fluid injection cycle. While the third fluid injection cycle is being carried out, the control unit 30 operates the second fill valve 65 to transfer a fourth portion of the fluid from the holding tank 58 to the second measuring tube 63 to replenish the fluid that was used in the second fluid injection cycle and refill the second measuring tube 63, and so on.

The foregoing sequence may continue indefinitely as a plurality of fluid injection cycles are carried out until all desired injection cycles are completed, or until insufficient fluid remains in the holding tank 58 to carry out additional injection cycles. In fact, if it is not necessary to be able to determine the volume of the fluid remaining in the holding tank after all fluid injection cycles are completed, the holding tank 58 may be refilled with fluid while the injection cycles continue, allowing the multi-port injection system 10 to carry out an indefinite number of fluid injection cycles without interruption for refilling fluid. The foregoing sequence, wherein after initial first and second fluid injection cycles are completed, the control unit 30 operates the first fill valve 55 and the second fill valve 65 in alternating fashion to refill the first measuring tube 53 and the second measuring tube 63 with additional portions of the fluid from the holding tank 58 as the other measuring tube provides a portion of the fluid for an on-going fluid injection cycle allows the multi-port injection system 10 to carry out a series of a plurality of fluid injection cycles without interruption for refilling fluid.

Once again, it is understood that the use herein of "first" and "second" to describe the fluid injection cycles and the portions of the fluid transferred from the holding tank 58 to the first measuring tube 53 and the second measuring tube 63 are meant merely to differentiate between the injection cycles and to differentiate between the portions of the fluid, and are not intended to mean that the "first" and "second" cycles must occur in immediate succession, that the "first" portion of the fluid must be used exclusively for a single "first" fluid injection cycle, or that the "second" portion of the fluid must be used exclusively for a single "second" fluid injection cycle. The same applies with respect to subsequent fluid injection cycles that may be described using terms such as "third," "fourth," etc.

The control unit 30 is configured to receive data from the first sensor 54 and the second sensor 64 and to use that data to accurately determine the volume of the fluid in the first measuring tube 53 and in the second measuring tube 63 respectively in a manner described further herein.

The control unit 30 is configured to determine, based on the determined volume of the fluid in the first measuring tube 53 following a fluid injection cycle and/or the determined volume of the fluid in the second measuring tube 63 following a fluid injection cycle, whether to operate the first fill valve 55 and/or the second fill valve 65 to transfer additional portions of the fluid from the holding tank 58 to refill the first measuring tube 53 and/or the second measuring tube 63.

Thus, for example, following a first fluid injection cycle in which a first portion of the fluid from the first measuring tube 53 was injected and after the excess first portion of the fluid that was not injected is returned to the first measuring tube 53, the control unit 30 receives data from the first sensor 54 and determines the volume of the first portion of the fluid remaining in the first measuring tube 53. If the control unit 30 determines that the volume of the first portion of the fluid remaining in the first measuring tube 53 is sufficient to carry out a second fluid injection cycle, it initiates the second fluid injection cycle using the remaining first portion of the fluid. Following the second fluid injection cycle, the control unit 30 repeats the process. If following the first fluid injection cycle or any subsequent fluid injection cycle using the first portion of the fluid, the control unit 30 determines that the volume of the first portion of the fluid remaining in the first measuring tube 53 is not sufficient to carry out the second or any subsequent fluid injection cycle, the control unit 30 initiates the second or subsequent fluid injection cycle using a second portion of fluid from the second measuring tube 63. The control unit 30 then operates the first fill valve 55 to transfer a volume of a third portion of the fluid from the holding tank 58 to the first measuring tube 53 to replenish the volume of the first portion of the fluid that was injected.

Similarly, following a second or subsequent fluid injection cycle in which a second portion of the fluid from the second measuring tube 63 was injected and after the excess second portion of the fluid that was not injected is returned to the second measuring tube 63, the control unit 30 receives data from the second sensor 64 and determines the volume of the second portion of the fluid remaining in the second measuring tube 63. If the control unit 30 determines that the volume of the second portion of the fluid remaining in the second measuring tube 63 is sufficient to carry out a third or subsequent fluid injection cycle, it initiates the third or subsequent fluid injection cycle using the remaining second portion of the fluid. Following the second or subsequent fluid injection cycle, the control unit 30 repeats the process. If following the second fluid injection cycle or any subsequent fluid injection cycle using the second portion of the fluid, the control unit 30 determines that the volume of the second portion of the fluid remaining in the second measuring tube 63 is not sufficient to carry out the third or any subsequent fluid injection cycle, the control unit 30 initiates the third or subsequent fluid injection cycle using the third or subsequent additional portion of fluid from the first measuring tube 53. The control unit 30 then operates the second fill valve 65 to transfer a volume of a fourth portion of the fluid from the holding tank 58 to the second measuring tube 63 to replenish the volume of the second portion of the fluid that was injected.

The control unit 30 is configured to operate the control valve 56 (example embodiment of FIGS. 2-4) and the first control valve 56 and second control valve 57 (alternative example embodiment of FIG. 5) to selectively direct the portions of the fluid in the first measuring tube 53 and the second measuring tube 63 to the pump 52 for pumping to the plurality of port valves 71-78 during initial and subsequent fluid injection cycles. Thus, for a first fluid injection cycle following an initial fill operation, the control unit 30 is configured to operate the control valve 56 to direct a first portion of the fluid from the first measuring tube 53 to the pump 52 during the first fluid injection cycle. It does this by controlling the control valve 56 to place it in the first state wherein fluid is allowed to flow between the first measuring tube 53 and the pump 52.

When the first fluid injection cycle is completed and any excess first portion of fluid that was not injected is returned to the first measuring tube 53, the control unit 30 is configured to determine based on the first sensor 54 indication of volume of the first portion of the fluid present in the first measuring tube 53 whether a sufficient volume of the first portion of the fluid is present in the first measuring tube 53 to carry out a second or subsequent fluid injection cycle. If the volume of the first portion of the fluid present in the first measuring tube 53 is not sufficient to carry out a second or subsequent fluid injection cycle, the control unit 30 is configured to operate the control valve 56 (example embodiment of FIGS. 2-4) or the first control valve 56 and the second control valve 57 (alternative example embodiment of FIG. 5) to direct a second portion of the fluid from the second measuring tube 63 to the pump 52 and to carry out the second or subsequent fluid injection cycle. The control unit 30 accomplishes this by controlling the control valve 56 (example embodiment of FIGS. 2-4) to place it in the second state wherein fluid is allowed to flow between the second measuring tube 63 and the pump 52, or by controlling the first control valve 56 and the second control valve 57 (alternative example embodiment of FIG. 5) to place the first control valve 56 in the second state, wherein fluid from the first measuring tube 53 is blocked from flowing between the first measuring tube 53 and the pump 52, and the second control valve 57 in the first state, wherein fluid is allowed to flow between the second measuring tube 63 and the pump 52.

Following completion of the second or subsequent fluid injection cycle and the return of the excess fluid that was not injected to the second measuring tube 63, the control unit 30 similarly determines based on the second sensor 64 indication of volume of the second portion of the fluid present in the second measuring tube 63 whether a sufficient volume of the second portion of the fluid is present in the second measuring tube 63 to carry out a third or subsequent fluid injection cycle as described above. If the volume of the second portion of the fluid present in the second measuring tube 63 is not sufficient to carry out a third or subsequent fluid injection cycle, the control unit 30 is configured to operate the control valve 56 (example embodiment of FIGS. 2-4) or the first control valve 56 and the second control valve 57 (alternative example embodiment of FIG. 5) to direct a third portion of the fluid from the first measuring tube 53 to the pump 52, and to carry out the third or subsequent fluid injection cycle. The control unit 30 accomplishes this by controlling the control valve 56 (example embodiment of FIGS. 2-4) to return to its first state wherein fluid is allowed to flow from the first measuring tube 53 to the pump 52, or by controlling the first control valve 56 and the second control valve 57 (alternative example embodiment of FIG. 5) to place the second control valve 57 in the second state, wherein fluid from the second measuring tube 63 is blocked from flowing between the second measuring tube 63 and the pump 52, and the first control valve 56 in the first state, wherein fluid is allowed to flow between the first measuring tube 53 and the pump 52. The control unit 30 then initiates the third or subsequent fluid injection cycle.

The foregoing sequence continues and is repeated following the completion of each fluid injection cycle. The control unit 30 thus operates the control valve 56 (example embodiment of FIGS. 2-4) or the first control valve 56 and the second control valve 57 (alternative example embodiment of FIG. 5) to alternately direct a portion of fluid from the first measuring tube 53 and a portion of fluid from the second measuring tube 63 to the pump 52 for pumping to the plurality of port valves 71-78 for injection into the injection ports during a series of a plurality of fluid injection cycles. Combined with the process of transferring fluid from the holding tank 56 alternately to the first measuring tube 53 and the second measuring tube 63 as described above, by controlling the control valve 56 to alternately direct portions of the fluid to flow from the first measuring tube 53 and the second measuring tube 63 to the pump 52, the multi-port injection system 10 is able to carry out a plurality of fluid injection cycles for a plurality of injection points 81-87 continuously and without interruption.

As noted, the control unit 30 is configured to determine whether the volume of a first, additional, or subsequent portion of fluid present in the first measuring tube 53 is sufficient to carry out a subsequent fluid injection cycle, and whether the volume of a second, additional, or subsequent portion of fluid present in the second measuring tube 63 is sufficient to carry out a third or subsequent fluid injection cycle. To make these determinations, the control unit 30 is configured to compare the first sensor 54 indication of volume of the first, additional, or subsequent portion of the fluid present in the first measuring tube 53 after a first or subsequent fluid injection cycle with a predetermined value of a volume of fluid necessary to carry out the second or subsequent fluid injection cycle. Similarly, the control unit 30 is configured to compare the second sensor 64 indication of volume of the second, additional, or subsequent portion of the fluid present in the second measuring tube 63 after a second or subsequent fluid injection cycle with a predetermined value of a volume of fluid necessary to carry out the third or subsequent fluid injection cycle. The control unit 30 is configured to calculate the value of the volume of fluid required for the first, second, third, fourth and each subsequent fluid injection cycle to be carried out based on the total amount of fluid to be injected each day for each port as input from a user of the multi-port injection system 10, and based on the calculated number of cycles remaining in the day.

As mentioned previously, the control unit 30 is configured to receive data from the first sensor 54 and the second sensor 64 and to use that data to accurately determine the volume of the fluid in the first measuring tube 53 and in the second measuring tube 63 respectively. The control unit 30 does this in a manner described further below. The control unit 30 is configured to determine the volume of the fluid in the first measuring tube 53 prior to a fluid injection cycle being carried out, and again after completion of the fluid injection cycle and the return of any excess fluid that was not injected to the first measuring tube 53. The control unit 30 thus accurately determines the volume of the fluid that was actually injected from the first measuring tube 53 during the fluid injection cycle.

Similarly, the control unit 30 is configured to determine the volume of the fluid in the second measuring tube 63 prior to a fluid injection cycle being carried out, and again after completion of the fluid injection cycle and the return of any excess fluid that was not injected to the second measuring tube 63. The control unit 30 thus accurately determines the volume of the fluid that was actually injected from the second measuring tube 63 during the fluid injection cycle.

More particularly, the control unit 30 calculates an initial volume of the first portion of the fluid in the first measuring tube 53 based on data received from the first sensor 54 that indicates the level of the first portion of the fluid. The control unit 30 calculates the initial volume after the initial fill process and before a first fluid injection cycle is carried out. After completion of the first fluid injection cycle and after the excess first portion of the fluid remaining in the system and not injected during the first injection cycle has been returned to the first measuring tube 53, the control unit 30 calculates the volume of the remaining first portion of the fluid present in the first measuring tube 53 based on data received from the first sensor 54 that indicates the level of the remaining first portion of the fluid. The control unit 30 calculates the volume of the first portion of the fluid that was injected during the first injection cycle by subtracting the volume of the first portion of the fluid remaining in the first measuring tube 53 following completion of the first fluid injection cycle from the initial volume of the first portion of the fluid.

The control unit 30 calculates the initial volume and the remaining volume of the first portion of the fluid using a first density of the first fluid. The control unit is configured to receive the value of the first density as input data entered by a user of the multi-port injection system 10. In addition, the control unit 30 can receive an indication of temperature from the temperature sensor 42 and use the temperature as a parameter for determining the initial and remaining volume of the first portion of the fluid to take account of expansion and contraction of the first portion of the fluid at different temperatures (i.e. the change in density).

The control unit 30 calculates an initial volume of the second portion of the fluid in the second measuring tube 63, the volume of the second portion of the fluid remaining and present in the second measuring tube 63 following a second or subsequent fluid injection cycle, and the volume of the second portion of the fluid that was injected during the second and each subsequent fluid injection cycle in the same manner described above with respect to the first portion of the fluid.

The control unit 30 performs the same calculations in the same manner to determine the volume of each portion of the fluid that was injected from the first measuring tube 53 and from the second measuring tube 63 during each subsequent injection cycle.

In this way, the volume of fluid actually injected into an injection port during an injection cycle is determined with a high degree of accuracy. The high degree of accuracy is possible because the volume of the fluid in the measuring tubes is measured after the excess fluid that was not actually injected during a fluid injection cycle and that remains in the system is returned to the measuring tube that provided it. Thus, the excess fluid is not "over-counted" in determining the volume of fluid that was injected during the cycle. Only the volume of fluid that was actually injected is counted. At the same time, because the excess fluid is returned to the measuring tube that provided it prior to a subsequent fluid injection cycle being initiated, the excess fluid is not inadvertently injected in the subsequent injection cycle, which would result in an "under-count" of the volume of fluid actually injected during the subsequent cycle. Accordingly, the multi-port injection system 10 provides a high degree of accuracy both in determining the volume of fluid actually injected during each individual fluid injection cycle, and in determining the volumes of fluids injected during a series of fluid injection cycles on a port-to-port basis. Without using the fluid return process of the multi-port injection system 10, deviations in port-to-port fluid volume measurements in the range of 80% were observed. Using the fluid return process, the deviation in port-to-port fluid volume measurements was dramatically reduced to about 1.5%.

The control unit 30 is configured to carry out a fluid injection cycle by controlling the control valve 56 (example embodiment of FIGS. 2-4) or the first control valve 56 and the second control valve 57 (alternative example embodiment of FIG. 5), the pump 52, and the plurality of port valves 71-78. Following an initial fill operation as described herein, the control unit 30 is configured to carry out a first fluid injection cycle in the following manner. The control unit 30 operates a selected first port valve of the plurality of port valves 71-78 to be in the open state. The control unit 30 then operates the control valve 56 (example embodiment of FIGS. 2-4) or the first control valve 56 and the second control valve 57 (alternative example embodiment of FIG. 5) in the manner described herein to direct the first portion of the fluid from the first measuring tube 53 to the pump 52. The control unit operates the pump 52 to pump the first portion of the fluid from the first measuring tube 53 to the selected first port valve of the plurality of port valves 71-78 for injection into a first fluid injection port of the plurality of fluid injection ports 81-88. When a predetermined time elapses or a predetermined volume of the first portion of the fluid has been provided by the first measuring tube 53, the control unit 30 operates the selected first port valve of the plurality of port valves 81-88 to be in the closed state.

After the selected first port valve is closed, the control unit 30 is configured to cause excess first portion of the fluid that was not actually injected into the first fluid injection port during the first fluid injection cycle to be returned to the first measuring tube 53. To accomplish this, the control unit 30 operates the fluid return valve 70 to return the first portion of the fluid that was not injected during the first fluid injection cycle to the first measuring tube 53.

More particularly, control unit 30 operates the fluid return valve 70 to be in its open state. The control unit 30 receives pressure data from the fluid pressure sensor 68 and determines the pressure the first portion of fluid that was not injected is under. The control unit 30 then operates the fluid return valve 70 to be in the closed state when the pressure the first portion of fluid is under is less than a first predetermined value.

Still more particularly, the control unit 30 operates the fluid return valve 70 to be in its open state. The control unit 30 receives pressure data from the fluid pressure sensor 68 and determines the pressure the first portion of fluid that was not injected and that is in the manifold 67 is under. The control unit 30 then operates the fluid return valve 70 to be in the closed state when the pressure the first portion of fluid in the manifold is under is less than a predetermined value.

The first predetermined value of pressure may be, for example, 50 psi. The value may be provided to the control unit 30 as input data by a user of the multi-port injection system 10. It may also be based on a parameter of the fluid return valve 70, particularly if the fluid return valve 70 comprises a pressure relief valve.

After the excess first portion of the fluid that was not actually injected into the first fluid injection port during the first fluid injection cycle is returned to the first measuring tube 53, the control unit 30 is configured to determine the volume of the first portion of the fluid that was actually injected into the selected first injection port during the first fluid injection cycle. The control unit 30 is configured to determine the volume of the first portion of the fluid that was injected during the first fluid injection cycle based on the first sensor 54 indication of volume of the first portion of the fluid present in the first measuring tube 53 before the first fluid injection cycle was initiated, and the first sensor 53 indication of volume of the first portion of the fluid present in the first measuring tube 53 after the first fluid injection cycle was completed. The control unit 30 is configured to determine the before and after volumes of the first portion of the fluid in the manner described herein above.

Following an initial fill operation as described herein, the control unit 30 is configured to carry out a second fluid injection cycle using a second portion of the fluid in the second measuring tube 63 in the same manner as described above for the first fluid injection cycle. The control unit 30 operates a selected second port valve of the plurality of port valves 71-78 to be in the open state. The control unit 30 then operates the control valve 56 (example embodiment of FIGS. 2-4) or the first control valve 56 and the second control valve 57 (alternative example embodiment of FIG. 5) in the manner described herein to direct the second portion of the fluid from the second measuring tube 63 to the pump 52. The control unit 30 operates the pump 52 to pump the second portion of the fluid from the second measuring tube 63 to the selected second port valve of the plurality of port valves 71-78 for injection into a second fluid injection port of the plurality of fluid injection ports 81-88. When a predetermined time elapses or a predetermined volume of the second portion of the fluid has been provided by the second measuring tube 63, the control unit 30 operates the selected second port valve of the plurality of port valves to be in the closed state.

After the second selected port valve is closed, the control unit 30 is configured to cause excess second portion of the fluid that was not actually injected into the second fluid injection port during the second fluid injection cycle to be returned to the second measuring tube 63. To accomplish this, the control unit 30 operates the fluid return valve 70 to return the second portion of the fluid that was not injected during the second fluid injection cycle to the second measuring tube 63.

More particularly, the control unit 30 operates the fluid return valve 70 to be in its open state. The control unit 30 receives pressure data from the fluid pressure sensor 68 and determines from the pressure sensor the pressure the second portion of the fluid that was not injected is under. The control unit 30 then operates the fluid return valve 70 to be in the closed state when the pressure the second portion of the fluid is under is less than a second predetermined value.

Still more particularly, the control unit 30 operates the fluid return valve 70 to be in its open state. The control unit 30 receives pressure data from the fluid pressure sensor 68 and determines the pressure the second portion of fluid that was not injected and that is in the manifold 67 is under. The control unit 30 then operates the fluid return valve 70 to be in the closed state when the pressure the second portion of fluid in the manifold is under is less than a second predetermined value.

The control unit 30 may obtain the second predetermined value of pressure in the same manner as the first predetermined value of pressure used in connection with returning excess fluid that was not injected in the first fluid injection cycle as described above. The second predetermined value of pressure may be the same as or different than the first predetermined value of pressure. In fact, a different value of predetermined pressure may be used in connection with returning excess fluid that was not injected for every fluid injection cycle if desired, based on the different pressure characteristics of the injection points being serviced.

After the excess second portion of the fluid that was not actually injected into the second fluid injection port during the second fluid injection cycle is returned to the second measuring tube 63, the control unit 30 is configured to determine the volume of the second portion of the fluid that was actually injected into the selected second injection port during the second fluid injection cycle. The control unit 30 is configured to determine the volume of the second portion of fluid that was actually injected during the second fluid injection cycle in the same manner as described above for determining the volume of the first portion of the fluid that was actually injected during the first fluid injection cycle.

The control unit 30 is configured to carry out each subsequent fluid injection cycle after the initial first fluid injection cycle and the second fluid injection cycle in the same manner as described above. As described herein, whether the control unit 30 causes second and subsequent fluid injection cycles to be carried out using portions of fluid from the first measuring tube 53 or the second measuring tube 63 depends on the control unit 30 determining upon completion of a fluid injection cycle whether the measuring tube that provided the portion of fluid for the that cycle has a sufficient volume of fluid remaining to carry out the next subsequent fluid injection cycle. That determination is made in the same manner described herein above.

The first fluid injection cycle, the second fluid injection cycle, and each subsequent fluid injection cycle may have a duration that is based on a preset time or on a preset volume of fluid provided or delivered by the first measuring tube 53 and/or the second measuring tube 63. The control unit 30 may receive these parameters based on calculations of total amount of fluid to inject and time to inject derived from input from a user of the multi-port injection system 10.

O. Operation of Preferred Embodiment.

Figure 6:
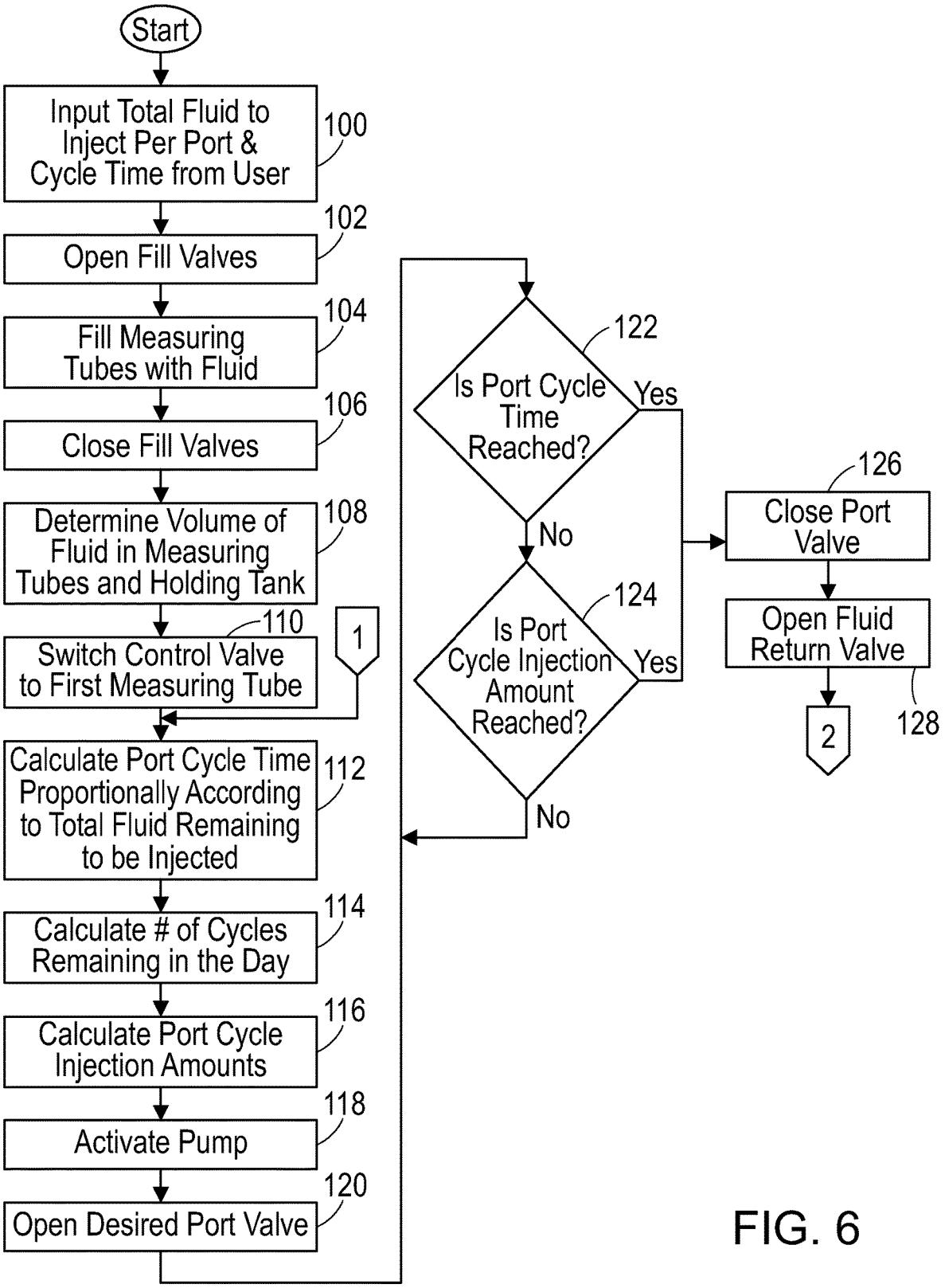
FIG. 6 is a flowchart illustrating a portion of the overall functionality of a multi-port injection system in accordance with an example embodiment.
Figure 7:
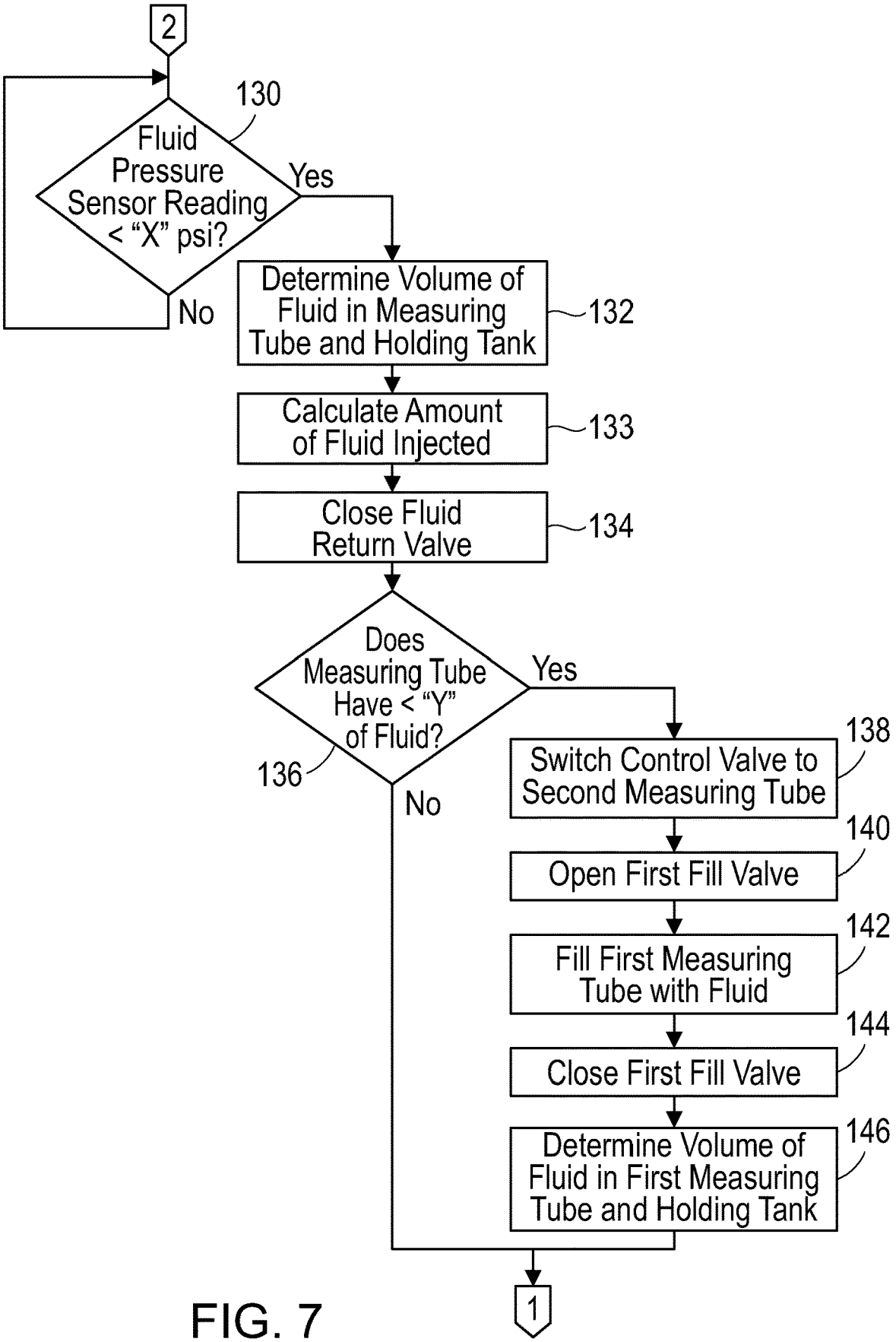
FIG. 7 is a flowchart illustrating a portion of the overall functionality of a multi-port injection system in accordance with an example embodiment.

An example of use and operation of the multi-port injection system 10 will now be described in connection with FIGS. 6-7 primarily.

Initially, in step 100 a user inputs to the system the total fluid to inject into each port and a cycle time, which indicates how often the multi-port injection system 10 should cycle through all of the active fluid injection ports. The active fluid injection ports may, for example, be one or more fluid injection ports associated with fluid injection points, such as wells 81-88.

In steps 102-106, an initial fill operation is carried out. In step 102, the control unit 30 opens the first fill valve 55 and the second fill valve 65. In step 104, the first measuring tube 53 and the second measuring tube 63 are filled with a volume of fluid, such as water, an additive, or another chemical to be injected into the active fluid injection ports of the fluid injection points. As described herein, the first measuring tube 53 is filled with a first portion of the fluid from the holding tank 58 and the second measuring tube 63 is filled with a second portion of the fluid from the holding tank 58. Once the first measuring tube 53 and the second measuring tube 63 are filled with a desired volume of fluid, in step 106 the control unit 30 closes the first fill valve 55 and the second fill valve 65.

In step 108, the volume of the fluid in the first measuring tube 53 and the volume of the fluid in the second measuring tube 63 is determined in the manner described herein.

In steps 110-116, the system prepares to carry out a series of fluid injection cycles. In step 110, the control unit 30 controls the control valve 56 (example embodiment of FIGS. 2-4) or the first control valve 56 and the second control valve 57 (alternative example embodiment of FIG. 5) in the manner described herein to place the first measuring tube 53 in fluid communication with the pump 52 and to direct the first portion of the fluid from the first measuring tube 53 to the pump 52. In step 112, the control unit 30 calculates a fluid injection cycle time or port cycle time for each active port. The fluid injection cycle or port cycle times for each active port are calculated proportionally according to the total fluid remaining to be injected for a desired time period, for example a day. In step 114 the control unit 30 calculates the number of total fluid injection cycles or port cycles remaining in the desired period, e.g., the day, based on the total cycle time input by the user in step 100 and the time remaining in the desired time period, e.g., the day. In step 116, the control unit 30 calculates the volume of fluid to be injected into each active port in a fluid injection or port cycle.

In steps 118-146 the system carries out a series of fluid injection or port cycles. In step 118, the control unit 30 activates the pump 52 and in step 120, the control unit 30 operates a selected port valve, such as a selected port valve of the plurality of port valves 71-78, to place the selected port valve in the open state. The first portion of the fluid then flows from the first measuring tube 53 and is injected through the selected port valve into a fluid injection port of a fluid injection point to which it is connected, as shown in FIG. 2 by the direction of the arrows relative to the first measuring tube 53. During the fluid injection cycle or port cycle, at decision steps 122 and 124 the control unit 30 determines if the fluid injection cycle or port cycle time has elapsed and if the calculated volume of fluid to be injected into the selected injection port during the fluid injection or port cycle has been reached. If neither condition has occurred, the fluid injection cycle or port cycle continues. When the control unit 30 determines that either condition is satisfied, in step 126 the control unit 30 operates the selected port valve to place it in the closed position.

The system next causes excess first portion of the fluid that was not actually injected during the first fluid injection cycle or port cycle to be returned to the first measuring tube 53 in the manner described herein. In step 128, the control unit 30 controls the fluid return valve 70 to place it in the open state. As described herein, opening the fluid return valve 70 releases the pressure remaining in the system from the first fluid injection or port cycle and the excess first portion of the fluid that was not injected flows under the influence of that pressure through the fluid return valve 70 and returns to the first measuring tube 53, as shown in FIG. 3 by the direction of the arrows relative to the first measuring tube 53. In decision step 130, the control unit 30 determines from the fluid pressure sensor 68 the pressure the fluid remaining in the system is under, for example the pressure in the manifold 67. If the control unit 30 determines that the pressure has dropped below a predetermined level "X", for example 50 psi, then sufficient pressure has been released, the excess first portion of the fluid has returned to the first measuring tube 53, and the system is stable. If the pump 52 remains activated, it continues to recirculate the first portion of the fluid between the first measuring tube 53 and the fluid return valve 70. The system typically reaches a stable condition, which is shown by the absence of arrows showing fluid flow into the first measuring tube 53 in FIG. 4, in a relatively short period of time after the selected port valve is closed in step 126. Until the control unit 30 determines that the pressure has dropped below the predetermined level "X," excess first portion of the fluid continues to flow back to the first measuring tube 53.

Once the control unit 30 has determined that the fluid pressure has dropped below the predetermined level "X" and that the system is stable, in step 132 the control unit 30 determines the volume of the first portion of the fluid in the first measuring tube 53 in the manner described herein. The volume of the first portion of the fluid comprises the combined volume of the first portion of the fluid that was not provided by the first measuring tube for the first fluid injection or port cycle, i.e., was not pumped from the first measuring tube 53 by the pump 52, and the volume of the first portion of the fluid that was provided for the first fluid injection cycle, but that was not actually injected before the first fluid injection cycle was completed and was returned to the first measuring tube 53 via the fluid return valve 70.

In step 133, the control unit 30 calculates very accurately the volume of the first portion of the fluid that was injected during the first fluid injection or port cycle, by subtracting the volume determined in step 132 from the volume determined in step 108 for the first cycle and in step 132 for subsequent cycles. It is also noted that if the holding tank 58 initially holds a known volume of the fluid, then the system also provides a highly accurate determination of the volume of fluid remaining in the holding tank 58 as fluid injection or port cycles are carried out based on the highly accurate determinations of the volumes of fluids in the first measuring tube 53 and the second measuring tube 63 following an initial fill operation, and subsequently following each fluid injection or port cycle.

After measuring the remaining volume of the first portion of the fluid in the first measuring tube 53 in step 132, the control unit 30 operates the fluid return valve 70 to place it in the closed state in step 134.

The control unit 30 then determines in decision step 136 whether the measured volume is less than a value "Y," where "Y" is the volume of fluid needed to carry out the next fluid injection or port cycle. The value "Y" may represent volume directly or indirectly, for example as inches of fluid in the measuring tube. The control unit 30 previously calculated the value of "Y" for each fluid injection or port cycle in step 116. If the control unit 30 determines that the volume of the first portion of the fluid remaining in the first measuring tube 53 exceeds "Y," then the system returns to step 112 and continues with the next fluid injection or port cycle using the remaining first portion of the fluid in the first measuring tube 53. If, however, the control unit 30 determines that the volume of the first portion of the fluid in the first measuring tube 53 is less than "Y," for example less than six inches, it proceeds to switch over from the first measuring tube 53 to the second measuring tube 63 for the next fluid injection cycle or ort cycle.

In step 138, the control unit 30 operates the control valve 56 (example embodiment of FIGS. 2-4) or the first control valve 56 and the second control valve 57 (alternative example embodiment of FIG. 5) in the manner described herein to place the second measuring tube 63 in fluid communication with the pump 52 and to direct the second portion of the fluid from the second measuring tube 63 to the pump 52. In step 140, the control unit 30 then opens the first fill valve 55 and in step 142 the first measuring tube is refilled with a third portion of fluid from the holding tank 58. Once the first measuring tube is refilled, the control unit 30 closes the first fill valve in step 144. The control unit then again determines the volume of fluid in the first measuring tube 53 and the holding tank 58, in preparation for subsequent fluid injection or port cycles using the first measuring tube 53.

Finally, the system returns to step 112 and carries out a second or subsequent fluid injection or port cycle using the second portion of the fluid in the second measuring tube 63. Thereafter, the system continues to repeat the sequence of steps described, alternately refilling the first measuring tube 53 and second measuring tube 63 with additional portions of fluid from the holding tank 58, injecting the additional portions of fluid from the measuring tubes in an alternating fashion into the active injection ports in a series of fluid injection or port cycles, returning additional portions of fluid that were not injected during each fluid injection cycle to the measuring tube that provided it, and accurately determining for each fluid injection or port cycle the volume of fluid actually injected from a measuring tube, and the volume of fluid remaining in the holding tank 58. This sequence continues until the total fluid to inject input by the user in step 100 is reached.

Any and all headings are for convenience only and have no limiting effect. Unless otherwise defined, all technical and scientific terms used herein have the same meaning as commonly understood by one of ordinary skill in the art to which this invention belongs. Although specific terms are employed herein, they are used in a generic and descriptive sense only and not for purposes of limitation. All publications, patent applications, patents, and other references mentioned herein are incorporated by reference in their entirety to the extent allowed by applicable law and regulations.

The data structures and code described in this detailed description are typically stored on a computer readable storage medium, which may be any device or medium that can store code and/or data for use by a computer system. This includes, but is not limited to, magnetic and optical storage devices such as disk drives, magnetic tape, CDs (compact discs), DVDs (digital video discs), and computer instruction signals embodied in a transmission medium (with or without a carrier wave upon which the signals are modulated). For example, the transmission medium may include a telecommunications network, such as the Internet.

At least one embodiment of the multi-port injection system is described above with reference to block and flow diagrams of systems, methods, apparatuses, and/or computer program products according to example embodiments of the invention. It will be understood that one or more blocks of the block diagrams and flow diagrams, and combinations of blocks in the block diagrams and flow diagrams, respectively, can be implemented by computer-executable program instructions. Likewise, some blocks of the block diagrams and flow diagrams may not necessarily need to be performed in the order presented, or may not necessarily need to be performed at all, according to some embodiments of the invention. These computer-executable program instructions may be loaded onto a general-purpose computer, a special-purpose computer, a processor, or other programmable data processing apparatus to produce a particular machine, such that the instructions that execute on the computer, processor, or other programmable data processing apparatus create means for implementing one or more functions specified in the flow diagram block or blocks. These computer program instructions may also be stored in a computer-readable memory that can direct a computer or other programmable data processing apparatus to function in a particular manner, such that the instructions stored in the computer-readable memory produce an article of manufacture including instruction means that implement one or more functions specified in the flow diagram block or blocks. As an example, embodiments of the invention may provide for a computer program product, comprising a computer usable medium having a computer-readable program code or program instructions embodied therein, the computer-readable program code adapted to be executed to implement one or more functions specified in the flow diagram block or blocks. The computer program instructions may also be loaded onto a computer or other programmable data processing apparatus to cause a series of operational elements or steps to be performed on the computer or other programmable apparatus to produce a computer-implemented process such that the instructions that execute on the computer or other programmable apparatus provide elements or steps for implementing the functions specified in the flow diagram block or blocks. Accordingly, blocks of the block diagrams and flow diagrams support combinations of means for performing the specified functions, combinations of elements or steps for performing the specified functions, and program instruction means for performing the specified functions. It will also be understood that each block of the block diagrams and flow diagrams, and combinations of blocks in the block diagrams and flow diagrams, can be implemented by special-purpose, hardware-based computer systems that perform the specified functions, elements or steps, or combinations of special-purpose hardware and computer instructions.

The present invention may be embodied in other specific forms without departing from the spirit or essential attributes thereof, and it is therefore desired that the present embodiment be considered in all respects as illustrative and not restrictive. Many modifications and other embodiments of the multi-port injection system will come to mind to one skilled in the art to which this invention pertains and having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although methods and materials similar to or equivalent to those described herein can be used in the practice or testing of the multi-port injection system, suitable methods and materials are described above. Thus, the multi-port injection system is not intended to be limited to the embodiments shown, but is to be accorded the widest scope consistent with the principles and features disclosed herein.

What is claimed is:

1. A fluid injection system, comprising:

a holding tank for holding a fluid;

a first measuring tube coupled to the holding tank for receiving a first portion of the fluid;

a plurality of port valves, wherein each port valve of the plurality of port valves is adapted to be coupled to a fluid injection port of a plurality of fluid injection ports, wherein each port valve of the plurality of port valves has an open state and a closed state;

a pump coupled to the first measuring tube and to the plurality of port valves;

a fluid return valve coupled between the plurality of port valves and the first measuring tube;

a first sensor coupled to the first measuring tube, wherein the first sensor is operable to provide an indication of volume of the first portion of the fluid in the first measuring tube; and a control unit in communication with the plurality of port valves, the pump, the fluid return valve, and the first sensor, wherein the control unit is configured to:

carry out a first fluid injection cycle comprising:

operate the first port valve of the plurality of port valves to be in the open state; and operate the pump to pump the first portion of the fluid from the first measuring tube to the first port valve of the plurality of port valves for injection into a first fluid injection port of the plurality of fluid injection ports; and operate the first port valve of the plurality of port valves to be in the closed state;

operate the fluid return valve to return the first portion of the fluid that was not injected during the first fluid injection cycle to the first measuring tube;

determine a volume of the first portion of the fluid that was injected during the first fluid injection cycle based on the first sensor indication of volume of the first portion of the fluid present in the measuring tube before the first fluid injection cycle and the first sensor indication of volume of the first portion of the fluid present in the first measuring tube after the first fluid injection cycle.

2. The fluid injection system of claim 1, wherein each fluid injection port of the plurality of fluid injection ports comprises a fluid injection port of an oil well.

3. The fluid injection system of claim 1, wherein the fluid comprises water.

4. The fluid injection system of claim 1, wherein the fluid comprises a chemical.

5. The fluid injection system of claim 4, wherein the chemical comprises methanol.

6. The fluid injection system of claim 1, comprising:

a first fill valve coupled to the holding tank and to the first measuring tube;

wherein the control unit is in communication with the first fill valve; and wherein the control unit is configured to operate the first fill valve to transfer the first portion of the fluid from the holding tank to the first measuring tube.

7. The fluid injection system of claim 1, comprising:

a control valve coupled to the first measuring tube, the pump and the fluid return valve;

wherein the control unit is in communication with the control valve; and wherein the control unit is configured to operate the control valve to direct the first portion of the fluid from the first measuring tube to the pump during the first fluid injection cycle, and to direct the first portion of the fluid that was not injected during the first fluid injection cycle to the first measuring tube after the first fluid injection cycle.

8. The fluid injection system of claim 1, wherein the fluid return valve comprises a pressure relief valve.

9. The fluid injection system of claim 8, comprising:

a pressure sensor coupled to the pump and to the plurality of port valves, wherein the pressure sensor is operable to provide an indication of a pressure the first portion of fluid is under;

wherein the control unit is in communication with the pressure sensor;

wherein the fluid return valve has an open state and a closed state; and wherein the control unit being configured to operate the fluid return valve to return the first portion of the fluid that was not injected during the first fluid injection cycle to the first measuring tube comprises:

operate the fluid return valve to be in the open state;

determine from the pressure sensor the pressure the first portion of fluid is under; and operate the fluid return valve to be in the closed state when the pressure the first portion of fluid is under becomes less than a predetermined value.

10. The fluid injection system of claim 1, wherein the first sensor comprises a pressure sensor.

11. The fluid injection system of claim 1, comprising:

a plurality of check valves, wherein each check valve of the plurality of check valves is coupled to a port valve of the plurality of port valves, wherein each check valve is configured to prevent backflow through the port valve.

12. The fluid injection system of claim 1, wherein the first fluid injection cycle has a duration that is based on a preset time.

13. The fluid injection system of claim 1, wherein the first fluid injection cycle has a duration that is based on a preset volume of the first portion of the fluid.

14. The fluid injection system of claim 1, comprising a manifold coupled between the pump and the plurality of port valves for conducting the first portion of the fluid between the pump and the plurality of port valves.

15. The fluid injection system of claim 14, wherein:

the fluid return valve is coupled between the manifold and the first measuring tube; and wherein the control unit being configured to operate the fluid return valve to return the first portion of the fluid that was not injected during the first fluid injection cycle to the first measuring tube comprises to operate the fluid return valve to return the first portion of the fluid in the manifold that was not injected during the first fluid injection cycle to the first measuring tube.

16. The fluid injection system of claim 15, wherein the fluid return valve comprises a pressure relief valve.

17. The fluid injection system of claim 16, comprising:

a pressure sensor coupled to the manifold, wherein the pressure sensor is operable to provide an indication of a pressure the first portion of the fluid in the manifold is under;

wherein the fluid return valve has an open state and a closed state;

wherein the control unit is in communication with the pressure sensor; and wherein the control unit being configured to operate to return the first portion of the fluid in the manifold that was not injected during the first fluid injection cycle comprises:

operate the fluid return valve to be in the open state;

determine from the pressure sensor the pressure the first portion of fluid in the manifold is under; and operate the fluid return valve to be in the closed state when the pressure the first portion of fluid in the manifold is under becomes less than a predetermined value.

18. A fluid injection system, comprising:

a holding tank for holding a fluid;

a first measuring tube coupled to the holding tank for receiving a first portion of the fluid;

a second measuring tube coupled to the holding tank for receiving a second portion of the fluid;

a plurality of port valves, wherein each port valve of the plurality of port valves is adapted to be coupled to a fluid injection port of a plurality of fluid injection ports, wherein each port valve of the plurality of port valves has an open state and a closed state;

a pump coupled to the first measuring tube, to the second measuring tube, and to the plurality of port valves;

a control valve coupled to the first measuring tube, to the second measuring tube, and to the pump;

a fluid return valve coupled between the plurality of port valves and the first measuring tube and the second measuring tube;

a first sensor coupled to the first measuring tube, wherein the first sensor is operable to provide an indication of volume of the first portion of the fluid in the first measuring tube; and a control unit in communication with the first sensor, the control valve, the pump, the plurality of port valves, and the fluid return valve, wherein the control unit is configured to:

carry out a first fluid injection cycle comprising:

operate the first port valve of the plurality of port valves to be in the open state;

operate the control valve to direct the first portion of the fluid from the first measuring tube to the pump; and operate the pump to pump the first portion of the fluid from the first measuring tube to the first port valve of the plurality of port valves for injection into a first fluid injection port of the plurality of fluid injection ports; and operate the first port valve of the plurality of port valves to be in the closed state;

operate the fluid return valve to return the first portion of the fluid that was not injected during the first fluid injection cycle to the first measuring tube;

determine based on the first sensor indication of volume of the first portion of the fluid present in the first measuring tube whether a sufficient volume of the first portion of the fluid is present in the first measuring tube to carry out a second fluid injection cycle, and if the volume of the first portion of the fluid present in the first measuring tube is not sufficient to carry out a second fluid injection cycle, operate the control valve to direct the second portion of the fluid from the second measuring tube to the pump; and carry out the second fluid injection cycle.

19. The fluid injection system of claim 18, wherein the fluid comprises water.

20. The fluid injection system of claim 18, wherein the fluid comprises a chemical.

21. The fluid injection system of claim 20, wherein the chemical comprises methanol.

22. The fluid injection system of claim 18, comprising:

a plurality of check valves, wherein each check valve of the plurality of check valves is coupled to a port valve of the plurality of port valves, wherein each check valve is configured to prevent backflow through the port valve.

23. The fluid injection system of claim 18, wherein the first sensor comprises a pressure sensor.

24. The fluid injection system of claim 18, wherein the control unit is configured to operate the control valve to direct the first portion of the fluid that was not injected during the first fluid injection cycle to the first measuring tube after the first fluid injection cycle.

25. The fluid injection system of claim 18, wherein the control unit being configured to determine based on the first sensor indication of volume of the first portion of the fluid present in the measuring tube whether a sufficient volume of the first portion of the fluid is present to carry out a second fluid injection cycle, comprises the control unit being configured to compare the first sensor indication of volume of the first portion of the fluid present in the measuring tube after the first fluid injection cycle with a predetermined value of a volume of fluid necessary to carry out the second fluid injection cycle.

26. The fluid injection system of claim 18, wherein the control unit being configured to carry out the second fluid injection cycle comprises the control unit being configured to:

operate a second port valve of the plurality of port valves to be in the open state; and operate the pump to pump the second portion of the fluid from the second measuring tube to the second port valve of the plurality of port valves for injection into a second fluid injection port of the plurality of fluid injection ports; and operate the second port valve of the plurality of port valves to be in the closed state.

27. The fluid injection system of claim 26, wherein the first fluid injection cycle has a duration that is based on a preset time or a preset volume of the first portion of fluid, and wherein the second fluid injection cycle has a duration that is based on a preset time or a preset volume of the second portion of fluid.

28. The fluid injection system of claim 26, wherein the control unit is configured to operate the fluid return valve to return the second portion of the fluid that was not injected during the second fluid injection cycle to the second measuring tube.

29. The fluid injection system of claim 28, wherein the control unit is configured to operate the control valve to direct the second portion of the fluid that was not injected during the second fluid injection cycle to the second measuring tube after the second fluid injection cycle.

30. The fluid injection system of claim 28, comprising:

a pressure sensor coupled to the pump and to the plurality of port valves, wherein the pressure sensor is operable to provide an indication of a pressure the first portion of fluid is under and an indication of a pressure the second portion of fluid is under;

wherein the control unit is in communication with the pressure sensor;

wherein the fluid return valve has an open state and a closed state;

wherein the control unit being configured to operate the fluid return valve to return the first portion of the fluid that was not injected during the first fluid injection cycle to the first measuring tube comprises:

operate the fluid return valve to be in the open state;

determine from the pressure sensor the pressure the first portion of fluid is under; and operate the fluid return valve to be in the closed state when the pressure the first portion of fluid is under becomes less than a first predetermined value; and wherein the control unit being configured to operate the fluid return valve to return the second portion of the fluid that was not injected during the second fluid injection cycle to the second measuring tube comprises:

operate the fluid return valve to be in the open state;

determine from the pressure sensor the pressure the second portion of fluid is under; and operate the fluid return valve to be in the closed state when the pressure the second portion of fluid is under is less than a second predetermined value.

31. The fluid injection system of claim 28, comprising:

a second sensor coupled to the second measuring tube, wherein the second sensor is operable to provide an indication of volume of the second portion of the fluid in the second measuring tube;

the first measuring tube adapted to receive a third portion of the fluid from the holding tank;

wherein the control unit is in communication with the second sensor;

wherein the control unit is configured to:

determine based on the second sensor indication of volume of the second portion of the fluid present in the second measuring tube whether a sufficient volume of the second portion of the fluid is present in the second measuring tube to carry out a third fluid injection cycle, and if the volume of the second portion of the fluid present in the second measuring tube is not sufficient to carry out a third fluid injection cycle, operate the control valve to direct the third portion of the fluid from the first measuring tube to the pump; and carry out the third fluid injection cycle.

32. The fluid injection system of claim 31, wherein the second sensor comprises a pressure sensor.

33. The fluid injection system of claim 31, wherein the control unit being configured to determine based on the second sensor indication of volume of the second portion of the fluid present in the second measuring tube whether a sufficient volume of the second portion of the fluid is present to carry out a third fluid injection cycle, comprises the control unit being configured to compare the second sensor indication of volume of the second portion of the fluid present in the second measuring tube after the second fluid injection cycle with a predetermined value of a volume of fluid necessary to carry out the third fluid injection cycle.

34. The fluid injection system of claim 31, comprising:

a first fill valve coupled to the holding tank and to the first measuring tube;

a second fill valve coupled to the holding tank and to the second measuring tube;

wherein the control unit is in communication with the first fill valve and the second fill valve;

wherein the control unit is configured to operate the first fill valve to transfer the first portion of the fluid and the third portion of the fluid from the holding tank to the first measuring tube; and wherein control unit is configured to operate the second fill valve to transfer the second portion of the fluid from the holding tank to the second measuring tube.

35. The fluid injection system of claim 28, comprising a manifold coupled between the pump and the plurality of port valves for conducting the first portion of the fluid and the second portion of the fluid between the pump and the plurality of port valves.

36. The fluid injection system of claim 35, wherein:

the fluid return valve is coupled between the manifold and the first measuring tube and the second measuring tube;

wherein the control unit being configured to operate the fluid return valve to return the first portion of the fluid that was not injected during the first fluid injection cycle to the first measuring tube comprises to operate the fluid return valve to return the first portion of the fluid in the manifold that was not injected during the first fluid injection cycle to the first measuring tube; and wherein the control unit being configured to operate the fluid return valve to return the second portion of the fluid that was not injected during the second fluid injection cycle to the second measuring tube comprises to operate the fluid return valve to return the second portion of the fluid in the manifold that was not injected during the second fluid injection cycle to the second measuring tube.

37. The fluid injection system of claim 36, comprising:

a pressure sensor coupled to the manifold, wherein the pressure sensor is operable to provide an indication of a pressure the first portion of the fluid in the manifold is under, wherein the pressure sensor is operable to provide an indication of a pressure the second portion of the fluid in the manifold is under;

wherein the fluid return valve has an open state and a closed state;

wherein the control unit is in communication with the pressure sensor;

wherein the control unit being configured to operate to return the first portion of the fluid in the manifold that was not injected during the first fluid injection cycle comprises:

operate the fluid return valve to be in the open state;

determine from the pressure sensor the pressure the first portion of fluid in the manifold is under; and operate the fluid return valve to be in the closed state when the pressure the first portion of fluid in the manifold is under becomes less than a first predetermined value; and wherein the control unit being configured to operate to return the second portion of the fluid in the manifold that was not injected during the second fluid injection cycle comprises:

operate the fluid return valve to be in the open state;

determine from the pressure sensor the pressure the second portion of fluid in the manifold is under; and operate the fluid return valve to be in the closed state when the pressure the second portion of fluid in the manifold is under becomes less than a second predetermined value.

* * * * *